US010315446B2

(12) United States Patent
Togo et al.

(10) Patent No.: US 10,315,446 B2
(45) Date of Patent: Jun. 11, 2019

(54) RECORDING APPARATUS

(71) Applicant: SEIKO EPSON CORPORATION, Tokyo (JP)

(72) Inventors: Katsumi Togo, Shiojiri (JP); Hisayuki Akahane, Matsumoto (JP); Kenichi Shirota, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/918,951

(22) Filed: Mar. 12, 2018

(65) Prior Publication Data

US 2018/0281484 A1 Oct. 4, 2018

(30) Foreign Application Priority Data

Apr. 3, 2017 (JP) ..... 2017-073800

(51) Int. Cl.
*B41J 29/13* (2006.01)
*B41J 29/02* (2006.01)
*B41J 29/12* (2006.01)

(52) U.S. Cl.
CPC ..... *B41J 29/13* (2013.01); *B41J 29/02* (2013.01); *B41J 29/12* (2013.01)

(58) Field of Classification Search
CPC ..... B41J 29/13; B41J 29/02; B41J 29/12
See application file for complete search history.

(56) References Cited

U.S. PATENT DOCUMENTS 5,831,656 A * 11/1998 Chosa ..... B41J 29/02 347/108
6,588,624 B1 * 7/2003 Connors ..... E05D 7/12 16/341
2013/0063521 A1 3/2013 Muraki

FOREIGN PATENT DOCUMENTS

JP 2006-023575 A 1/2006
JP 2013-056504 A 3/2013

* cited by examiner

*Primary Examiner* — Geoffrey S Mruk
(74) *Attorney, Agent, or Firm* — Workman Nydegger

(57) ABSTRACT

A recording apparatus including a housing, an apparatus main body that constitutes an inside of the housing, the apparatus main body including a recording member that performs recording, a feed roller that feeds a medium, the medium being set at an inclined position, towards the recording member, an opening/closing body that opens/closes a portion above an area in which the recording member is disposed, and a damper that applies damping force to the opening/closing body when the opening/closing body is closed. The opening/closing body and the damper are attached to the apparatus main body through an attaching member disposed at an area above the feed roller.

10 Claims, 18 Drawing Sheets

RECORDING APPARATUS

BACKGROUND

1. Technical Field

The present invention relates to a recording apparatus that performs recording on a medium.

2. Related Art

In recording apparatuses, representative examples of which are fax machines and printers, there are cases in which an opening/closing body is provided above a moving area of a carriage including a recording head. There are cases in which the opening/closing body is merely a cover, or is a scanner as described in JP-A-2013-56504 and JP-A-2006-23575.

In JP-A-2013-56504, a configuration is disclosed in which a state in which a scanner unit 12 is open is maintained by an arm-like member (a sliding member 77). Furthermore, JP-A-2006-23575 discloses a configuration in which a hinge is configured by a damper.

In a case in which the opening/closing body is, particularly, a heavy object such as a scanner described in JP-A-2013-56504 described above, when closing the opening/closing body, the arm-like member needs to be disengaged such that the operation thereof is laborious, and when closing the opening/closing body, if the opening/closing body is closed using its own weight, there is a concern that the impact may be large generating a collision noise that is unpleasant to the ear and that the opening/closing body may be broken. Accordingly, it is desirable that a damper, such as the one in JP-A-2006-23575, that damps the closing movement of the opening/closing body is provided.

However, providing a damper increases the size of the product. Furthermore, not only the size of the product itself, there is a call for a reduction in the space needed when using the product, specifically, there is a call for a product that allows the opening/closing body to be opened without the need to pull out the product even when the product is placed in an installation space low in height.

SUMMARY

An advantage of some aspects of the invention is that an increase in the size of the apparatus, and the space needed when the apparatus is used can be both suppressed with a configuration including an opening/closing body and a damper that apply damping force when the opening/closing body is closed.

According to an aspect of the invention, a recording apparatus includes a housing, an apparatus main body that constitutes an inside of the housing, the apparatus main body including a recording member that performs recording on a medium, a feed roller that feeds the medium, the medium being set at an inclined position, towards the recording member, an opening/closing body that opens/closes a portion above an area in which the recording member is disposed, and a damper that applies damping force to the opening/closing body when the opening/closing body is closed. In the recording apparatus, the opening/closing body and the damper are attached to the apparatus main body through an attaching member disposed at an area above the feed roller.

There is a lot of space area above the feed roller that feeds the medium, which is set in an inclined position, towards the recording member. Accordingly, in the present aspect, the opening/closing body and the damper are attached to the apparatus main body through the attaching member disposed in the area above the feed roller. Accordingly, an increase in the size of the apparatus can be suppressed with the above.

Furthermore, since the attaching member is positioned above the feed roller that feeds the medium, which is set in an inclined position, towards the recording member, assuming that a horizontal direction extending along the feeding direction of the medium sent out from the feed roller is an apparatus depth direction, in the apparatus depth direction, the attaching member is positioned not at the edge portion of an apparatus rear side but at a position that is on an apparatus front side (the recording head side) with respect to the edge portion.

Furthermore, since the opening/closing body is attached in an openable/closable manner through the attaching member in between, a rotational center of the opening/closing body is also positioned at where the attaching member is positioned. In other words, the rotational center of the opening/closing body is also positioned not at the edge portion of the apparatus rear side but at a position that is on an apparatus front side with respect to the edge portion.

With the above, the distance between the rotational center of the opening/closing body and the rotation free edge becomes smaller, and the height of the rotation free edge of the opening/closing body can be reduced when the opening/closing body is opened. Accordingly, even when the apparatus is installed in an installation space that is low in height, the opening/closing body can be opened without pulling out the apparatus from the installed space, or even when the opening/closing body cannot be opened completely, a sufficient opening amount can be obtained, and user-friendliness can be improved.

It is preferable that the recording apparatus further include a carriage that includes the recording head constituting the recording member, the carriage reciprocating in an apparatus width direction, a center frame positioned between a moving area of the carriage and an area in which the feed roller is disposed, the carriage being provided so as to extend in a moving direction of the carriage, and two side frames provided at two sides of the center frame, in which the attaching member is fixed to the two side frames.

According to the above, since the attaching member is fixed to the two side frames provided at the two sides of the center frame, the rigidity of the frame body constituted by the center frame and the two side frames can be increased.

It is preferable that the recording apparatus further include a carriage that includes the recording head constituting the recording member, the carriage reciprocating in an apparatus width direction, and a center frame positioned between a moving area of the carriage and an area in which the feed roller is disposed, the carriage being provided so as to extend in a moving direction of the carriage, in which at least a portion of a pivot shaft of the opening/closing body and at least a portion of the damper is positioned above the center frame.

According to the above, since at least a portion of the pivot shaft of the opening/closing body and at least a portion of the damper are positioned above the center frame provided so as to extend in the moving direction of the carriage, the occupying area of the center frame and the occupying areas of the pivot shaft and the damper do not completely superimpose on each other in the apparatus depth direction; accordingly, the size in the apparatus depth direction can be suppressed.

It is preferable that the recording apparatus further include a carriage that includes the recording head constituting the recording member, the carriage reciprocating in an apparatus width direction, and a center frame positioned between a moving area of the carriage and an area in which the feed roller is disposed, the carriage being provided so as to extend in a moving direction of the carriage, in which at least a portion of the attaching member is positioned above the center frame.

According to the above, since at least a portion of the attaching member is positioned above the center frame provided so as to extend in the moving direction of the carriage, the occupying area of the center frame and the occupying area of the attaching member in the apparatus depth direction do not completely superimpose on each other in the height direction; accordingly, the size in the apparatus depth direction can be suppressed.

It is preferable that the attaching member be fixed to the center frame in the above recording apparatus that further includes the carriage that includes the recording head constituting the recording member, the carriage reciprocating in the apparatus width direction, and the center frame positioned between the moving area of the carriage and the area in which the feed roller is disposed, the carriage being provided so as to extend in the moving direction of the carriage, in which at least a portion of the attaching member is positioned above the center frame.

According to the above, in the configuration in which the attaching member is fixed to the center frame, suppression in the size in the apparatus depth direction can be achieved.

It is preferable in the recording apparatus, the opening/closing body include a main body portion and an arm portion that connects the main body portion and a rotational center of the main body portion and the opening/closing body, in which a top surface member constituting an apparatus upper surface together with the opening/closing body is provided above the attaching member, and in which the arm portion has a shape that avoids an edge portion of the top surface member when the opening/closing body is opened/closed.

According to the above, since the arm portion, which connects the main body portion of the opening/closing body and the rotational center, has the shape that avoids the edge portion of the top surface member when the opening/closing body is opened/closed, the main body portion and the edge portion of the top surface member can be made to be closer to each other. As a result, in a state in which the opening/closing body is closed, the gap between the main body portion and the edge portion of the top surface member can be made smaller, the entering of dust and the like into the apparatus through the gap can be suppressed, and the appearance of the apparatus can be improved.

It is preferable that a carriage that includes the recording head constituting the recording member, the carriage reciprocating in an apparatus width direction, and a center frame positioned between a moving area of the carriage and an area in which the feed roller is disposed, the carriage being provided so as to extend in a moving direction of the carriage, in which at least a portion of the attaching member is positioned above the center frame, be included in the above recording apparatus according to the first aspect, in which the opening/closing body includes the main body portion and the arm portion that connects the main body portion and the rotational center of the main body portion and the opening/closing body, in which the top surface member constituting the apparatus upper surface together with the opening/closing body is provided above the attaching member, and in which the arm portion has the shape that avoids the edge portion of the top surface member when the opening/closing body is opened/closed.

According to the above, since at least a portion of the arm portion is positioned above the center frame positioned between the moving area of the carriage and the area in which the feed roller is disposed, the occupying area of the center frame and the occupying area of the arm portion in the apparatus depth direction do not completely superimpose on each other; accordingly, the size in the apparatus depth direction can be suppressed.

It is preferable that a guide frame on a recording member side with respect to the center frame, the guide frame guiding the carriage in the moving direction, in which an upper end portion of the guide frame is at a position that is higher than an upper end portion of the center frame, and in which at least a portion of the arm portion is, in a height direction, positioned inside a step formed between the upper end portion of the guide frame and the upper end portion of the center frame, be included in the above recording apparatus in which a carriage that includes the recording head constituting the recording member, the carriage reciprocating in an apparatus width direction, and a center frame positioned between a moving area of the carriage and an area in which the feed roller is disposed, the carriage being provided so as to extend in a moving direction of the carriage, in which at least a portion of the attaching member is positioned above the center frame.

According to the above, since at least a portion of the arm portion is disposed inside the step formed by the upper end portion of the guide frame and the upper end portion of the center frame in the height direction, an increase in the size of the apparatus can be suppressed by effective use of the space.

It is preferable at least a portion of the attaching member is positioned above the feed roller in either one of the recording apparatuses described above.

According to the above, in the configuration in which at least a portion of the attaching member is positioned above the feed roller, functions and effects similar to those described above can be obtained.

It is preferable that a holding member that is attached to the attaching member, and that, in a state in which the holding member is attached to the attaching member, holds the damper be included in either one of the recording apparatuses described above.

According to the above, since a holding member that is attached to the attaching member and that, in a state in which the holding member is attached to the attaching member, holds the damper is included, the damper can be prevented from falling off when an assembly, which is formed by attaching the damper to the attaching member, is mounted on the apparatus main body; accordingly, the efficiency of the assembly work is improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
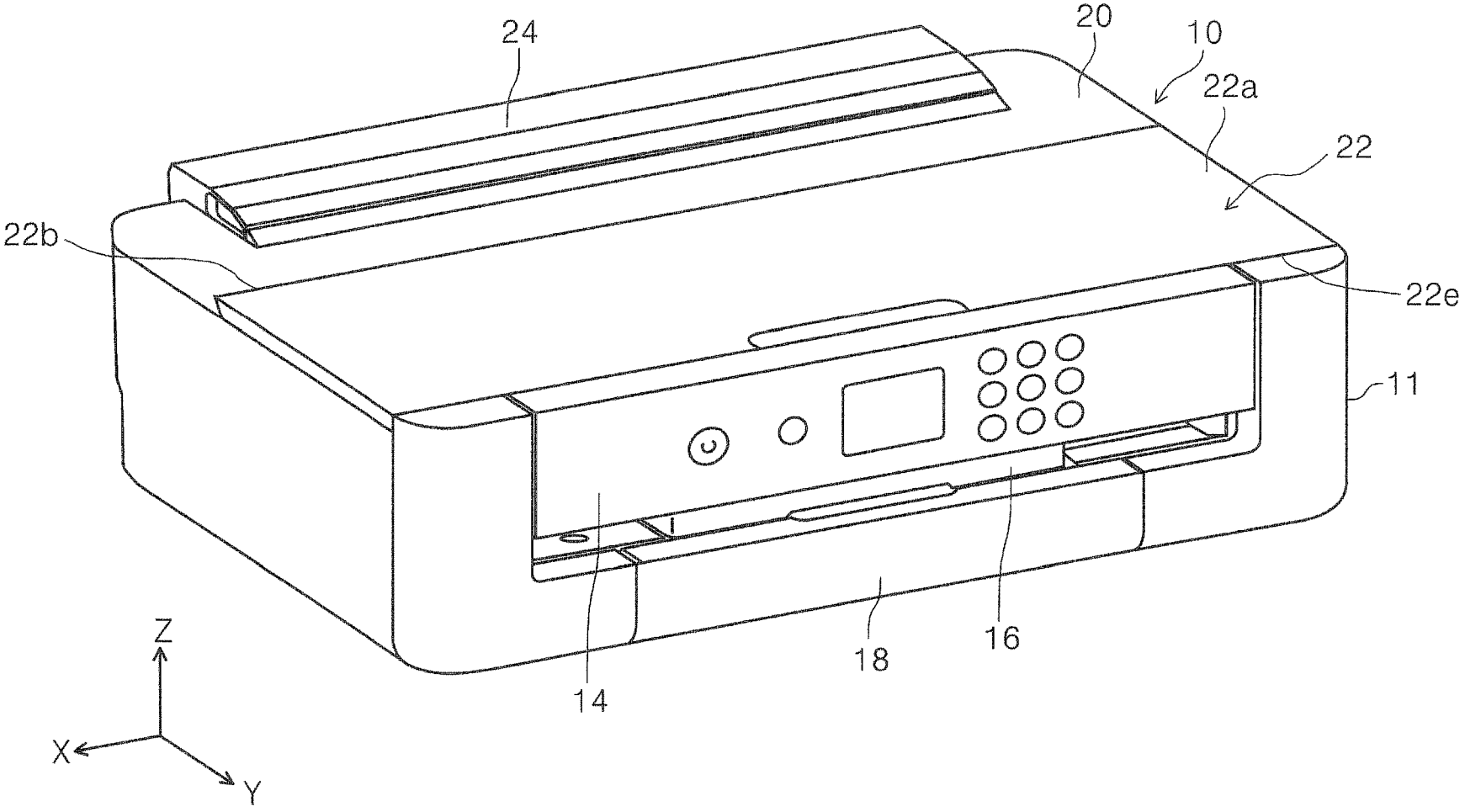
FIG. 1 is an external perspective view of a printer according to an exemplary embodiment of the invention.

Hereinafter, exemplary embodiments of the invention will be described with reference to the drawings. Note that components that are the same in each of the exemplary embodiments will be denoted with the same reference numerals. Description of such components will be given in only the first exemplary embodiment and will be omitted in the succeeding exemplary embodiment.

Figure 2:
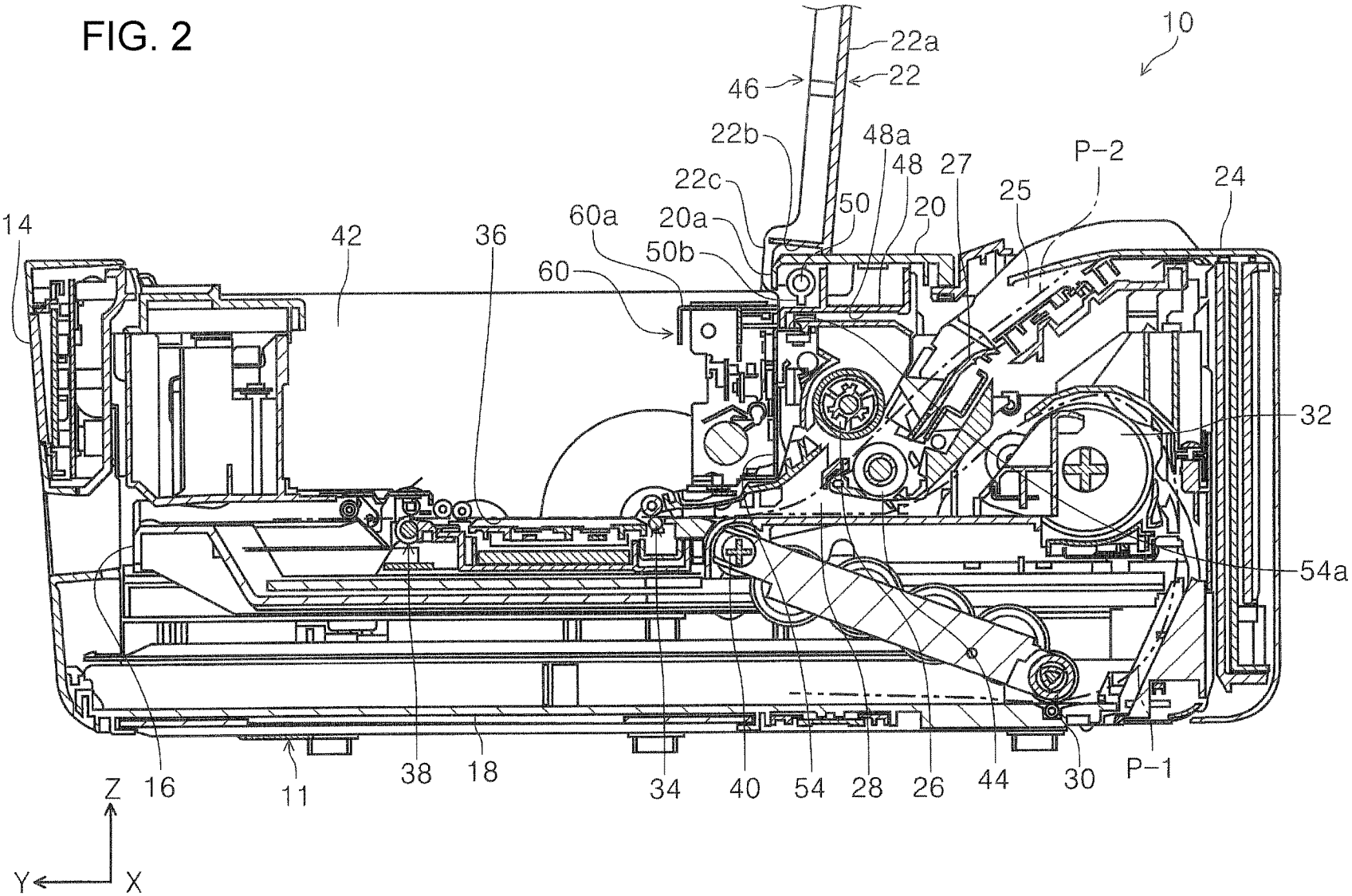
FIG. 2 is a sectional side view illustrating a transport path of a medium in the printer according to the exemplary embodiment of the invention.
Figure 3:
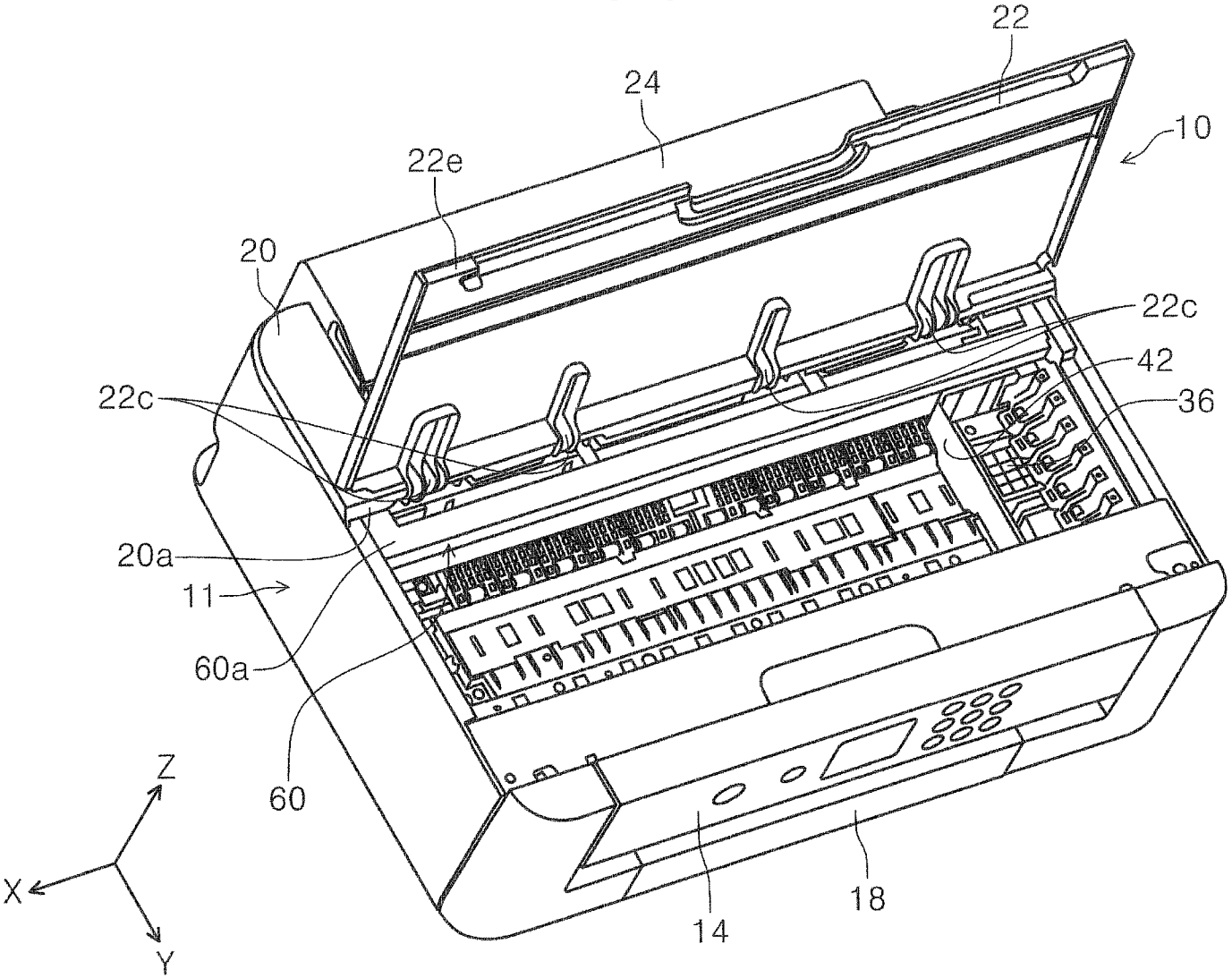
FIG. 3 is a perspective view illustrating the printer with a cover open.
Figure 4:
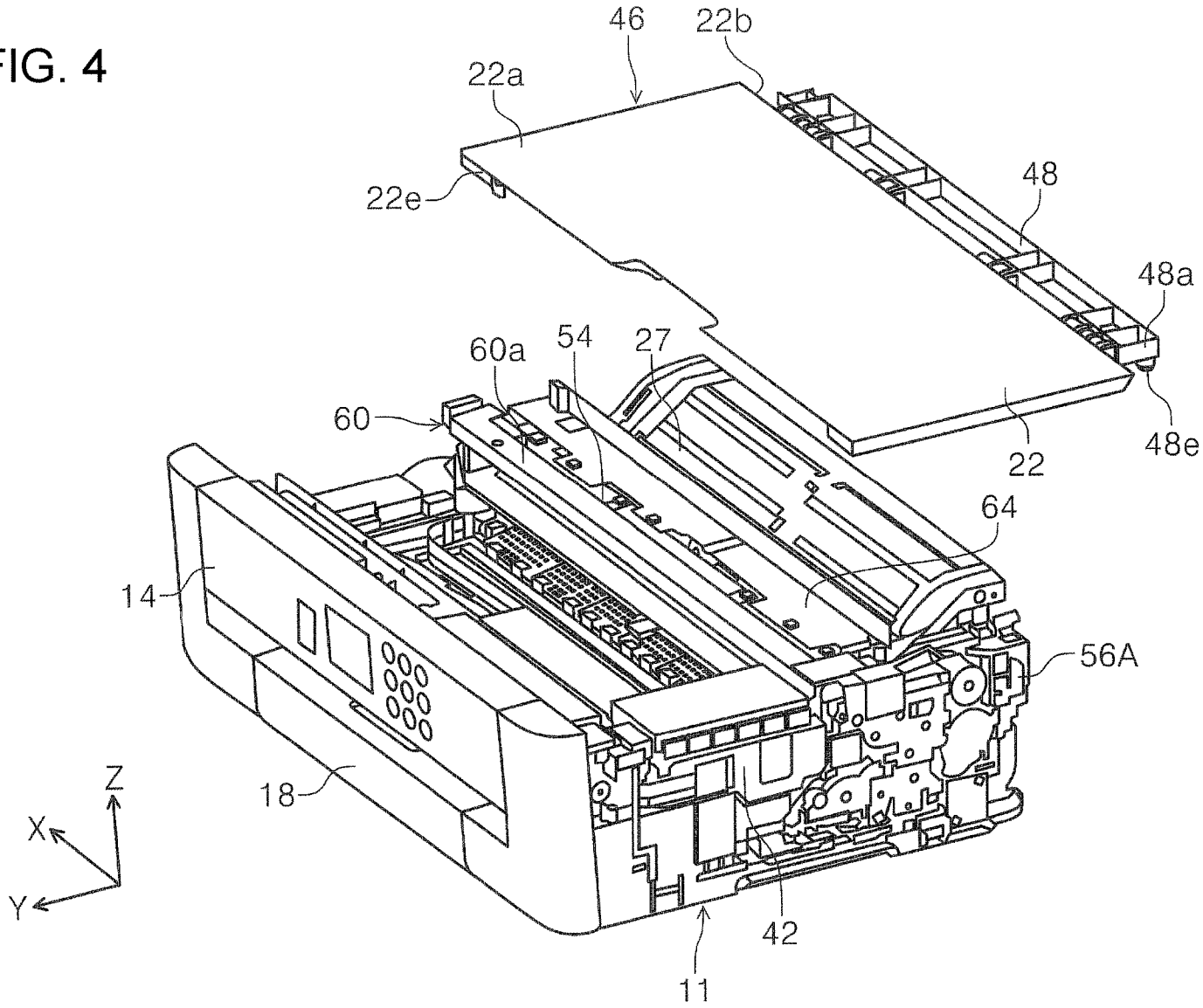
FIG. 4 is an exploded perspective view of an apparatus main body and the cover assembly.
Figure 5:
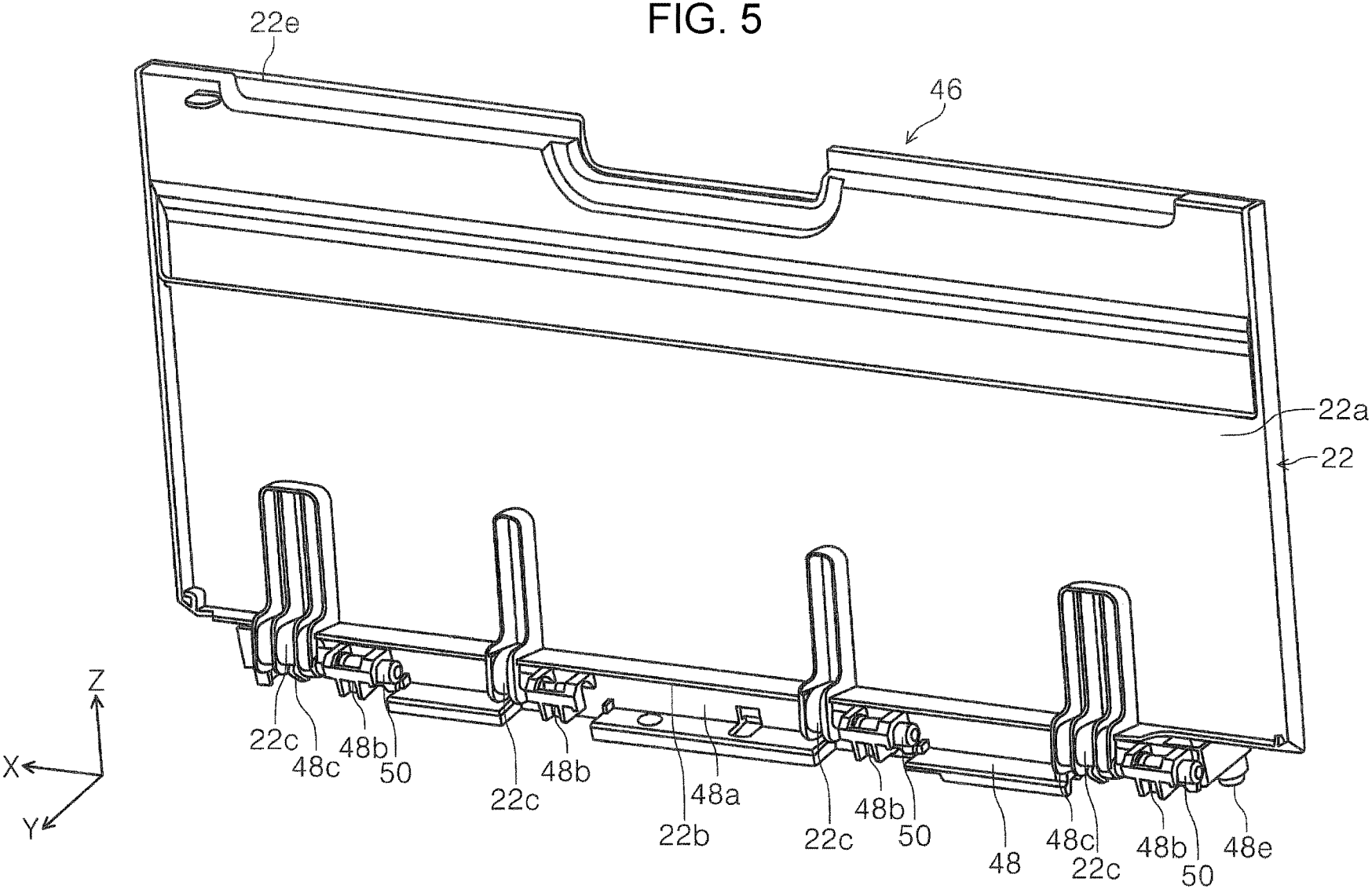
FIG. 5 is a perspective view of the cover assembly.

FIG. 1 is an external perspective view of a printer according to an exemplary embodiment of the invention, FIG. 2 is a sectional side view illustrating a transport path of a medium in the printer according to the exemplary embodiment of the invention, FIG. 3 is a perspective view illustrating the printer with the cover open, FIG. 4 is an exploded perspective view of an apparatus main body and the cover assembly, and FIG. 5 is a perspective view of the cover assembly.

Figure 6:
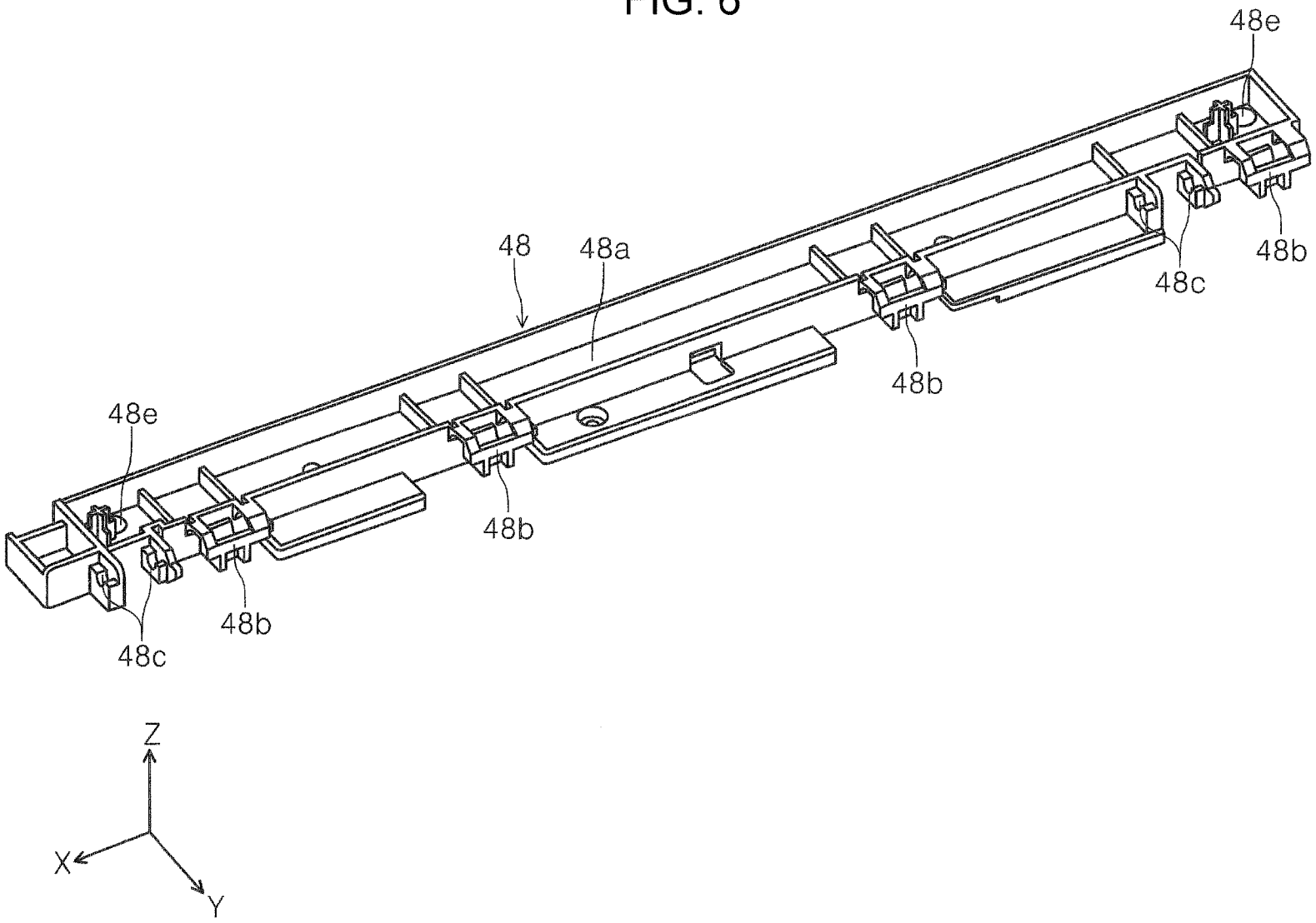
FIG. 6 is a perspective view of an attaching member.
Figure 7:
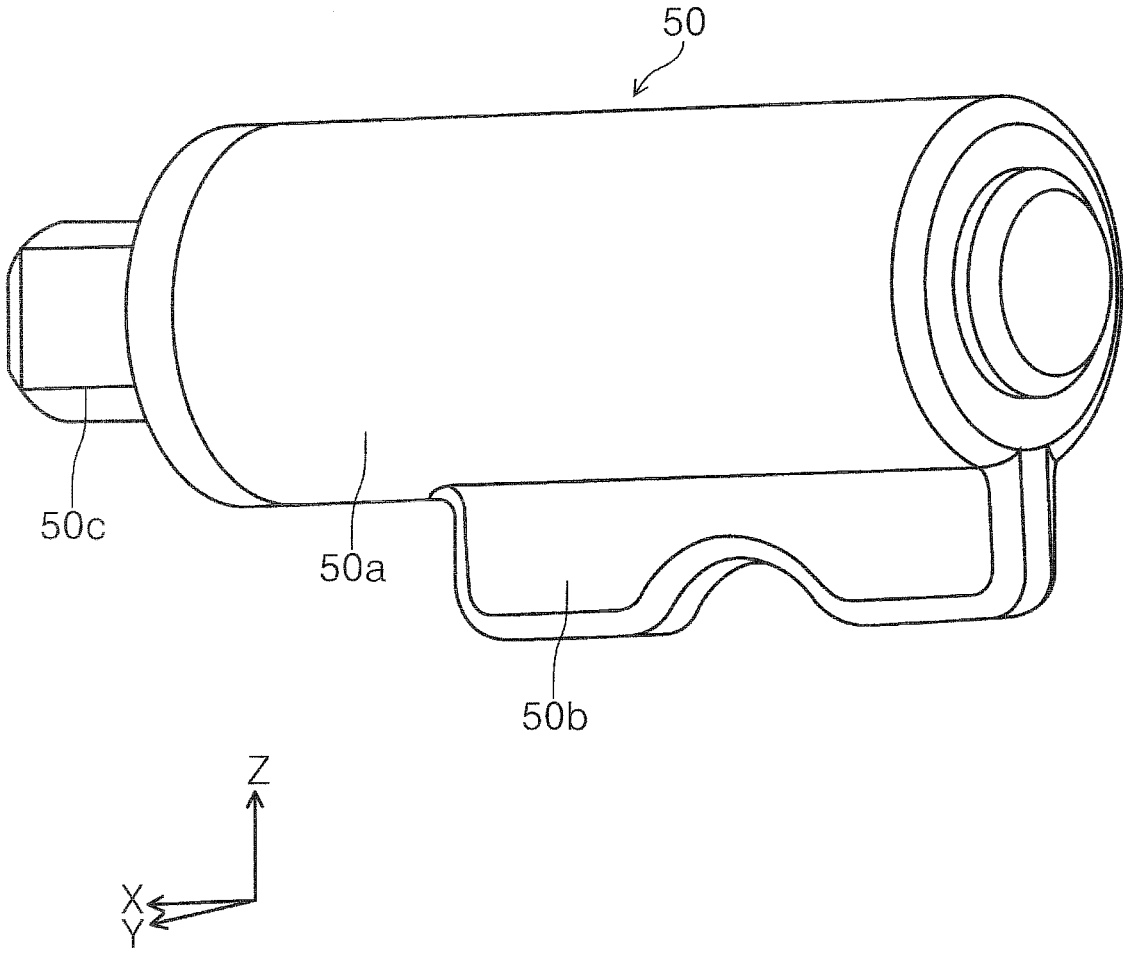
FIG. 7 is a perspective view of a damper.
Figure 8:
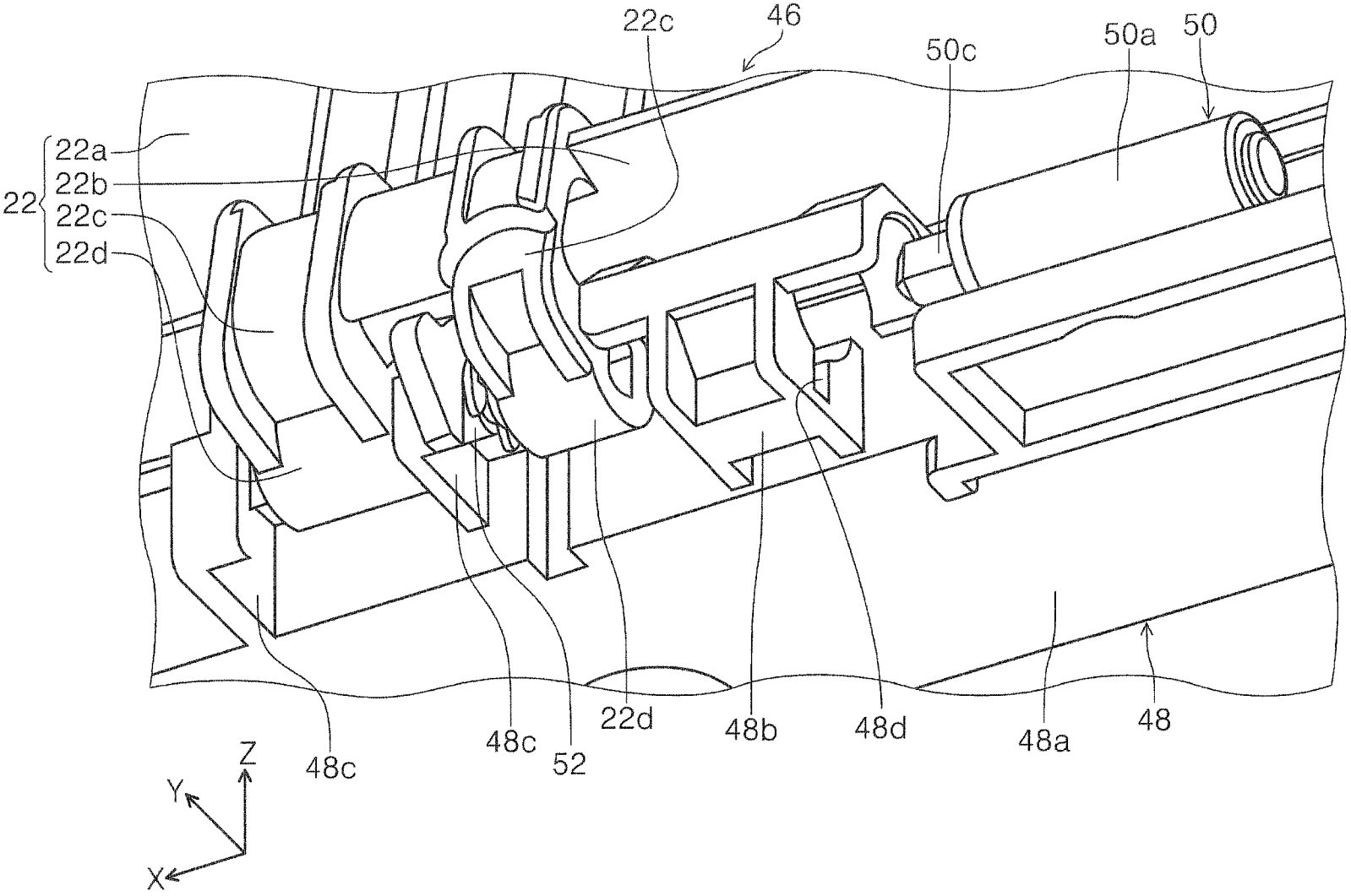
FIG. 8 is a perspective view of the cover assembly while being assembled.
Figure 9:
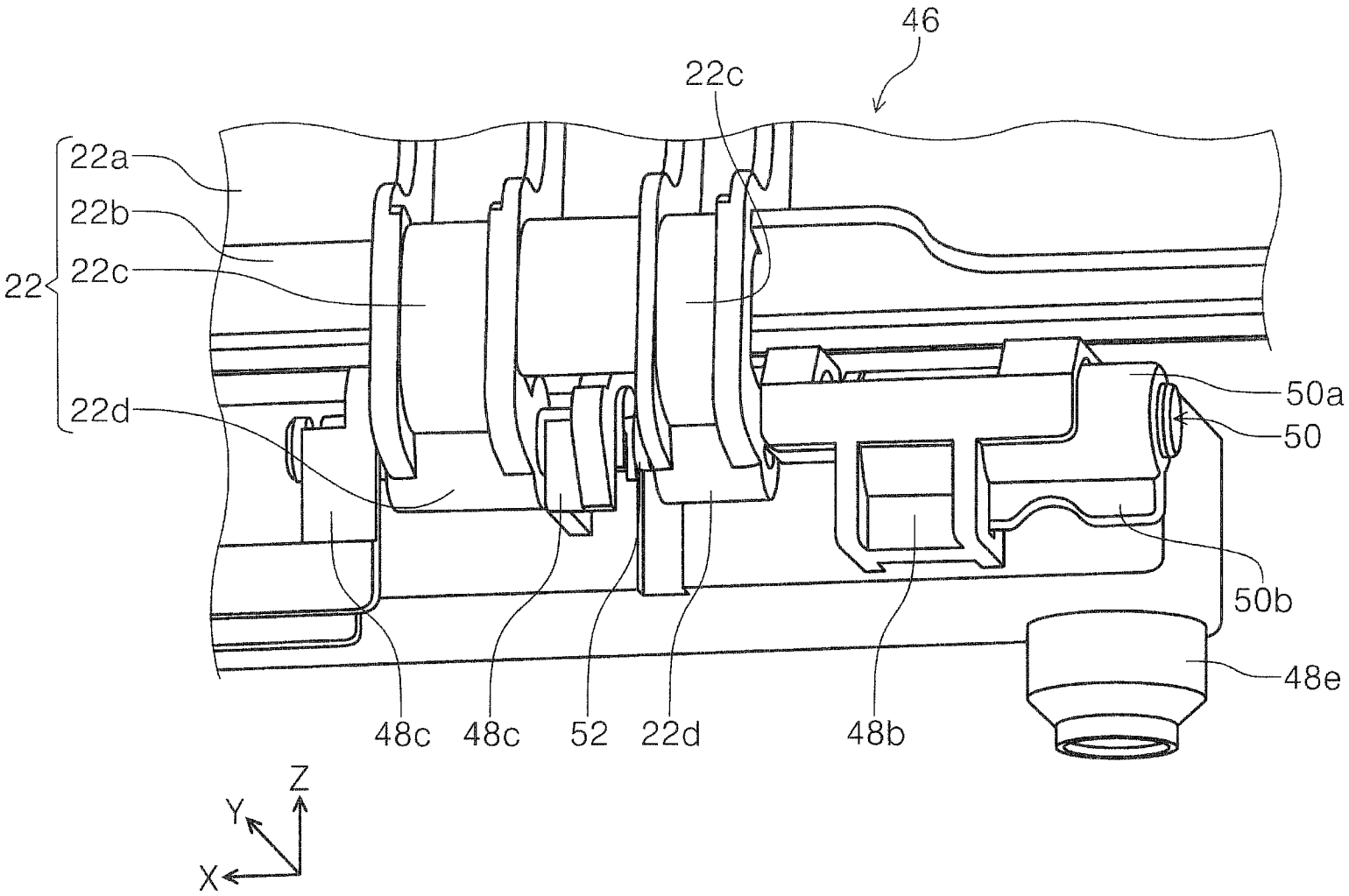
FIG. 9 is a perspective view illustrating a state in which the cover and the attaching member are connected to each other in the cover assembly with the damper interposed therebetween.
Figure 10:
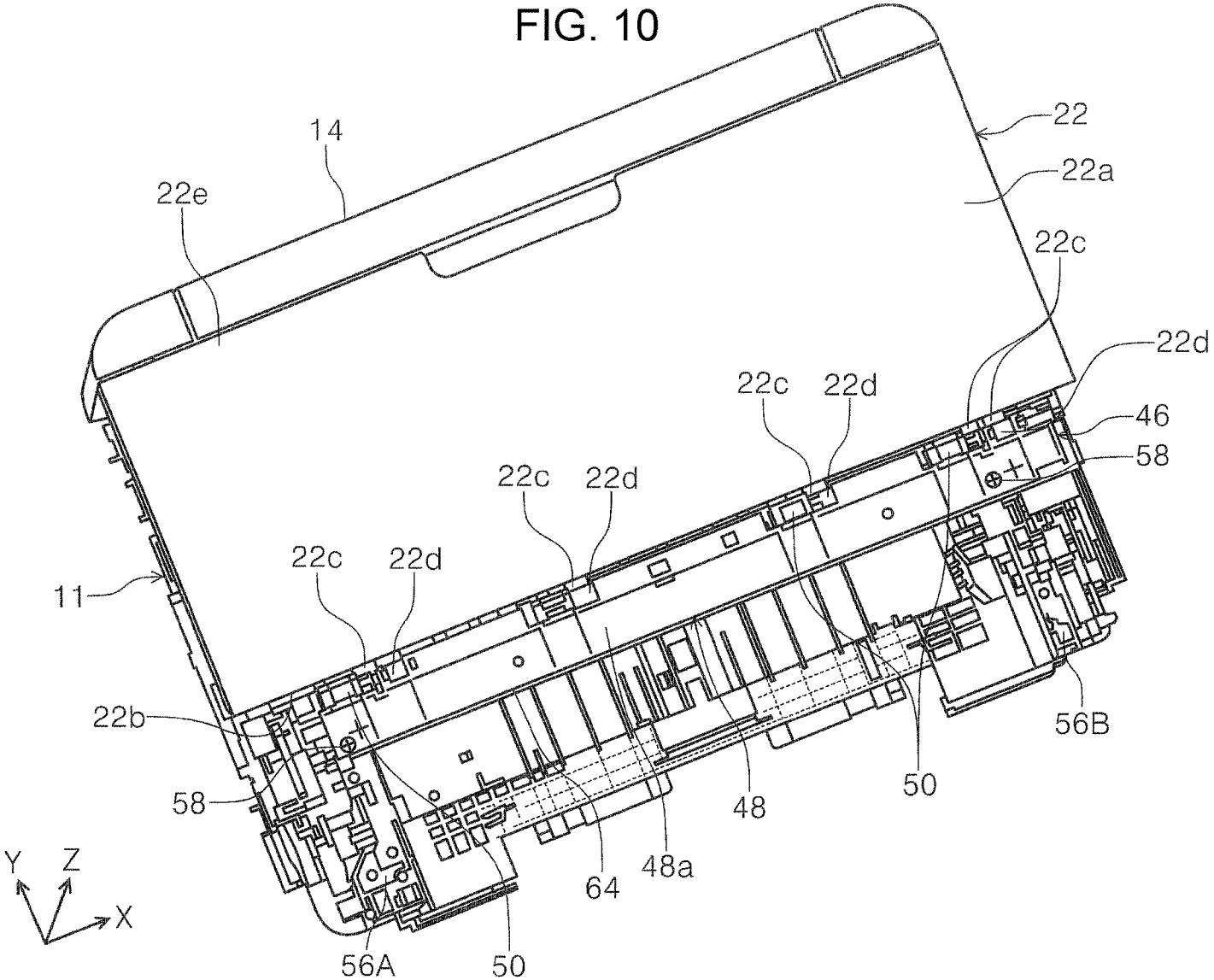
FIG. 10 is a perspective view illustrating a state in which the cover assembly is attached to the apparatus main body.

FIG. 6 is a perspective view of an attaching member, FIG. 7 is a perspective view of a damper, FIG. 8 is a perspective view of the cover assembly while being assembled, FIG. 9 is a perspective view illustrating the cover assembly in which a cover and the attaching member are connected to each other through the dampers interposed therebetween, and FIG. 10 is a perspective view illustrating a state in which the cover assembly is attached to the apparatus main body.

Figure 11:
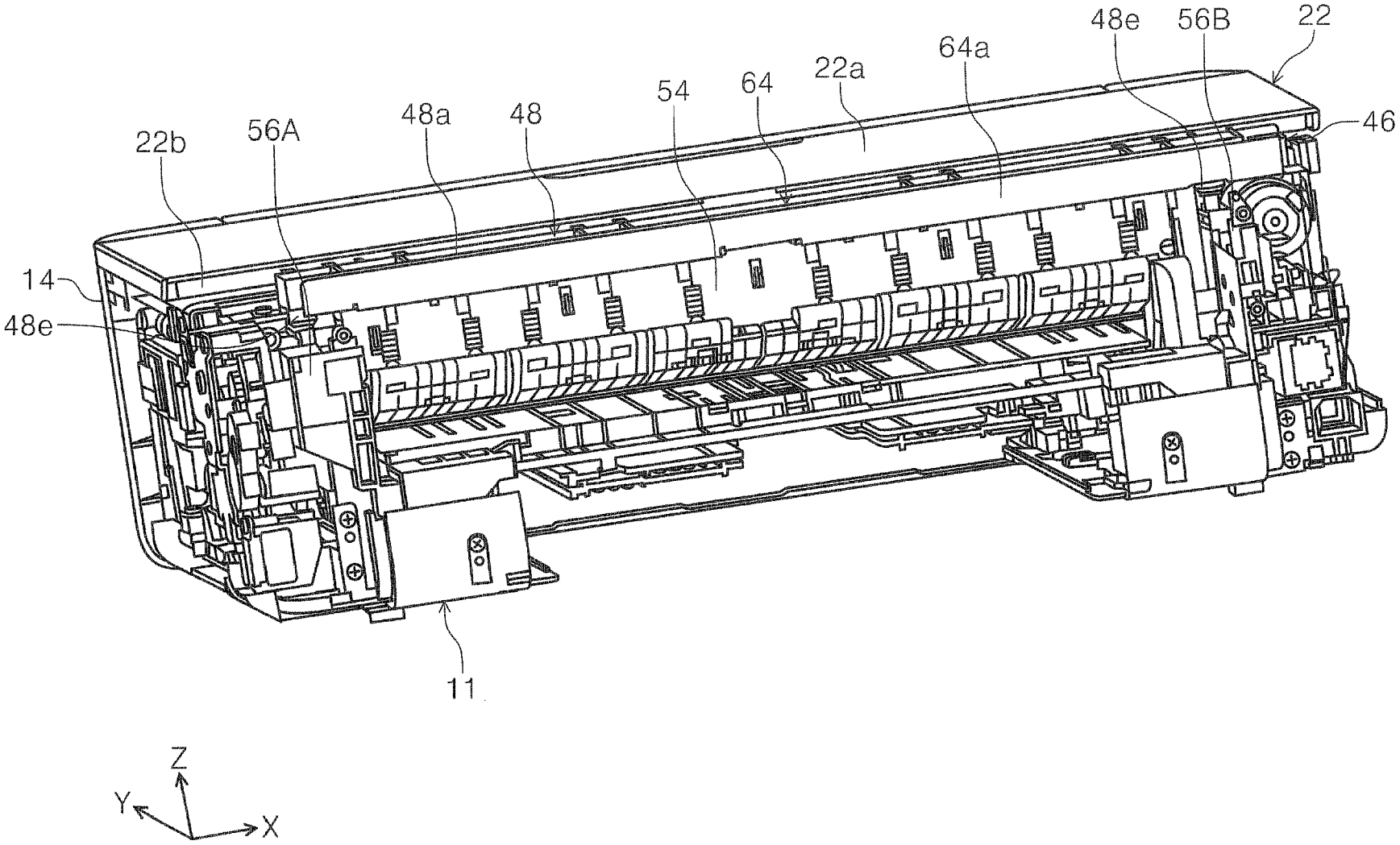
FIG. 11 is a perspective view illustrating the apparatus main body and an apparatus rear side of a cover assembly.
Figure 12:
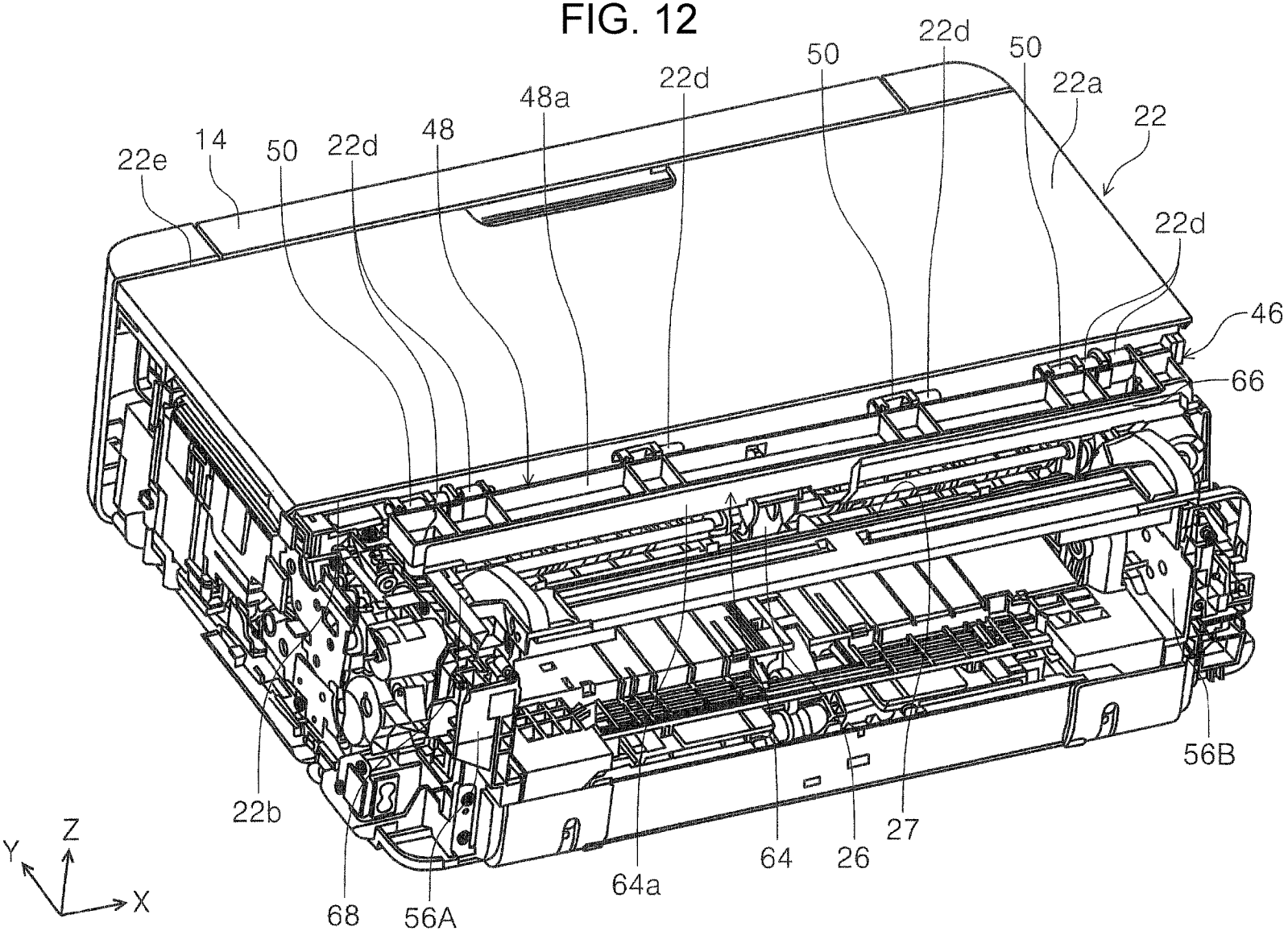
FIG. 12 is a perspective view illustrating the apparatus main body and the apparatus rear side of the cover assembly.
Figure 13:
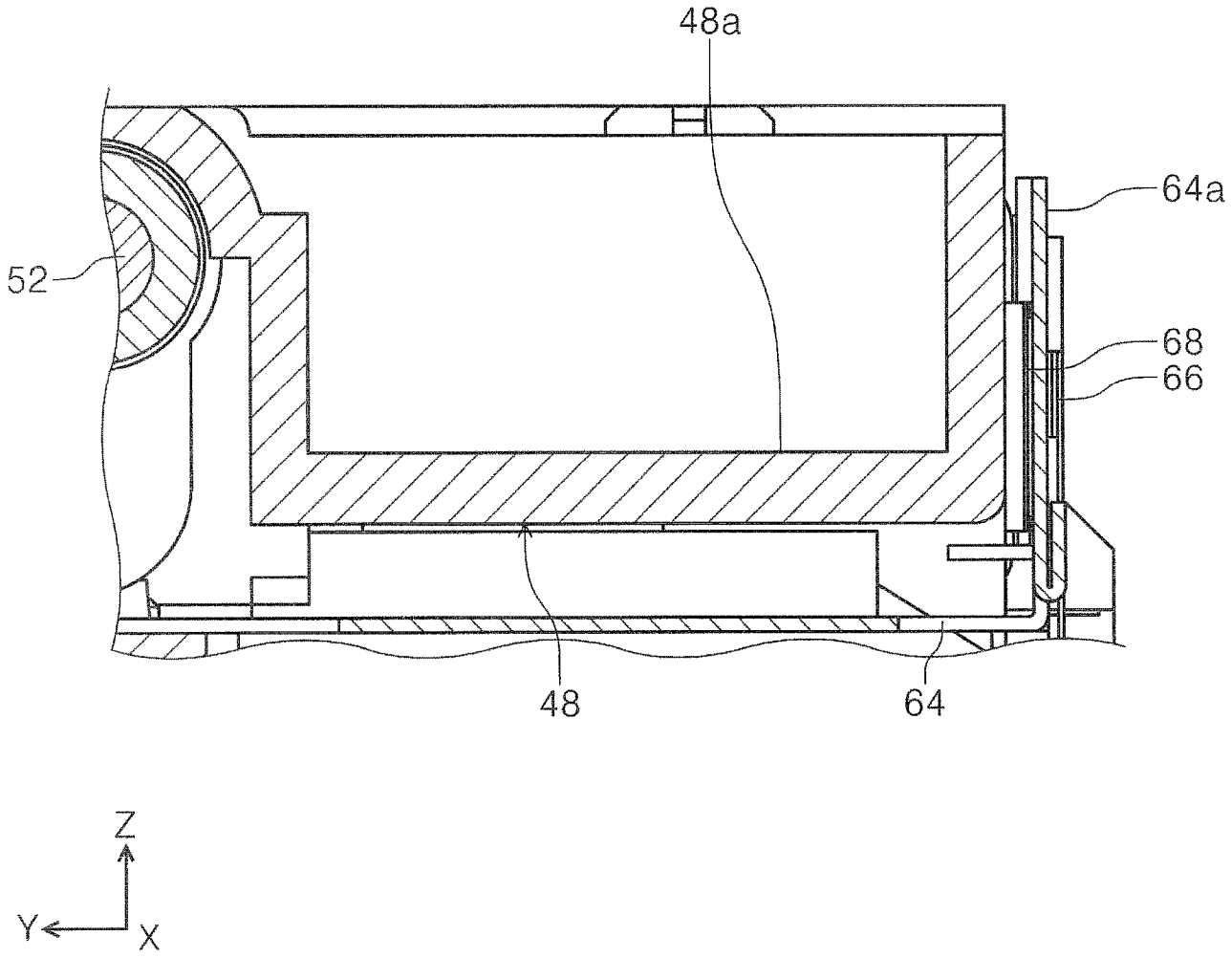
FIG. 13 is a cross-sectional view illustrating a relationship between the attaching member and a length of cable.
Figure 14:
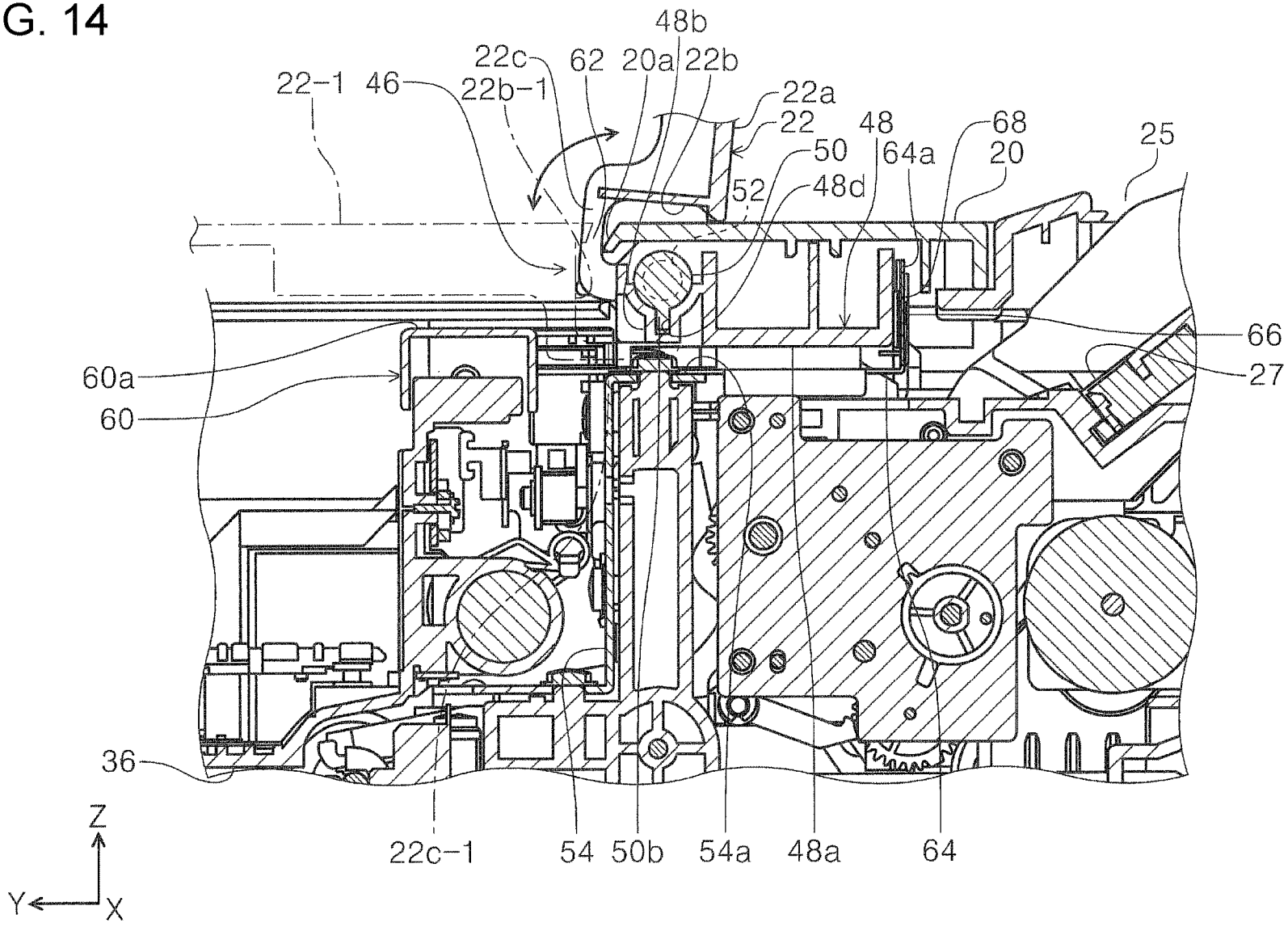
FIG. 14 is a cross-sectional view illustrating a portion around a pivot shaft of the cover assembly in a state in which the pivot shaft is attached to the apparatus main body.
Figure 15:
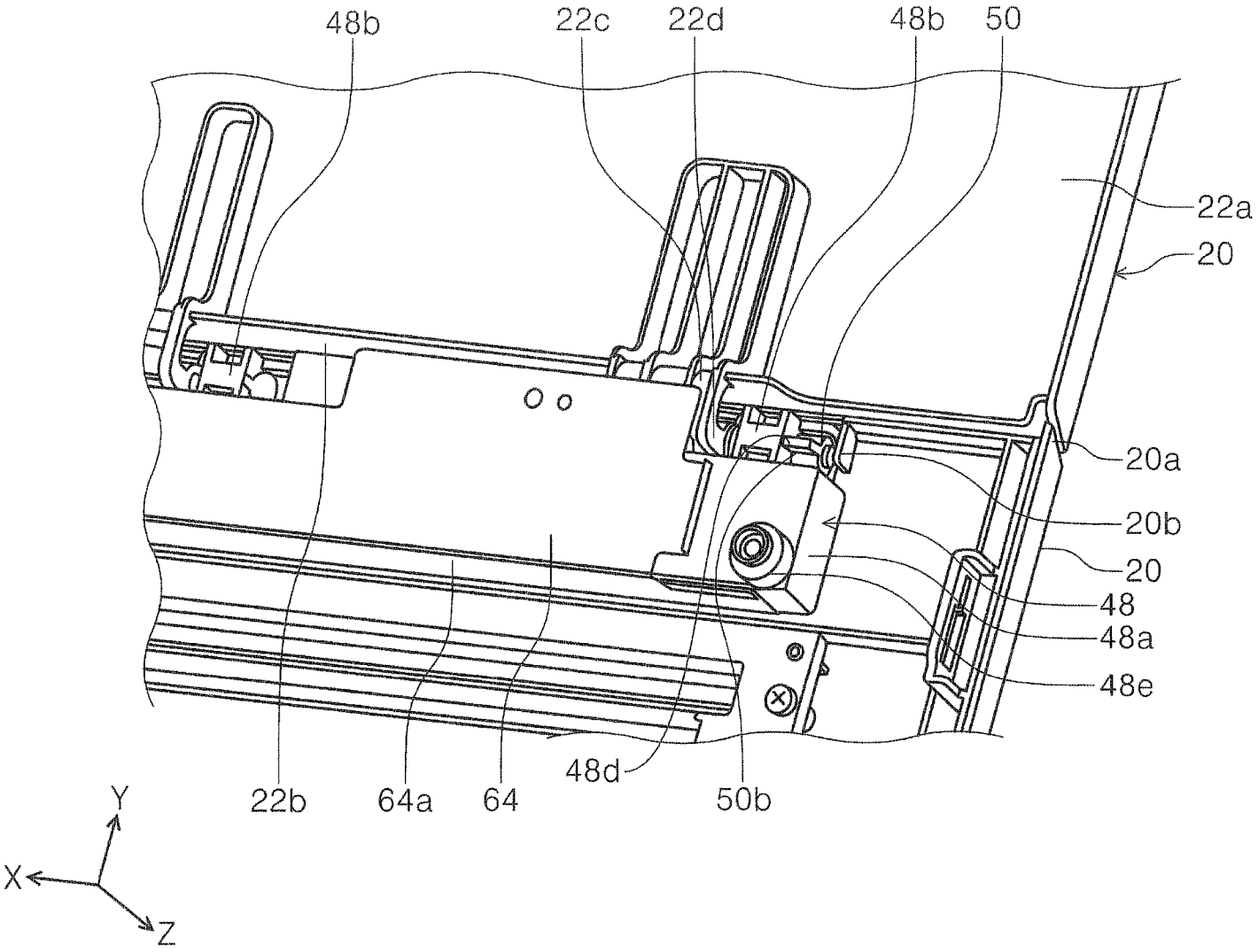
FIG. 15 is a perspective view illustrating a relationship between the damper and a top surface member.

FIG. 11 is a perspective view illustrating the apparatus main body and an apparatus rear side of a cover assembly, FIG. 12 is a perspective view illustrating the apparatus main body and the apparatus rear side of the cover assembly, FIG. 13 is a cross-sectional view illustrating a relationship between the attaching member and a length of cable, FIG. 14 is a cross-sectional view illustrating a portion around a pivot shaft of the cover assembly in a state in which the pivot shaft is attached to the apparatus main body, and FIG. 15 is a perspective view illustrating a relationship between the damper and a top surface member.

Figure 16:
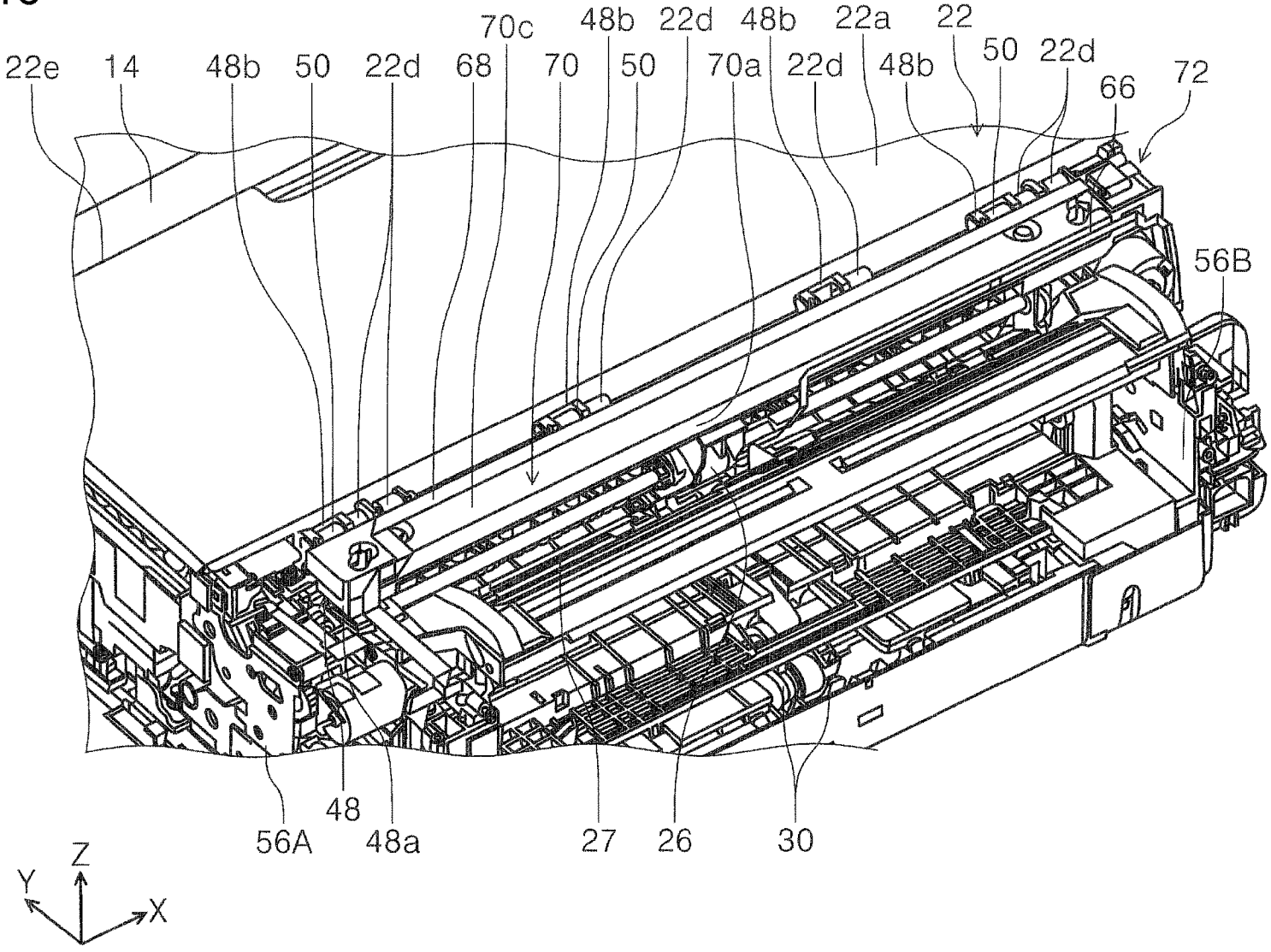
FIG. 16 is a perspective view illustrating a state in which a cover assembly according to a second exemplary embodiment is attached to the apparatus main body.
Figure 17:
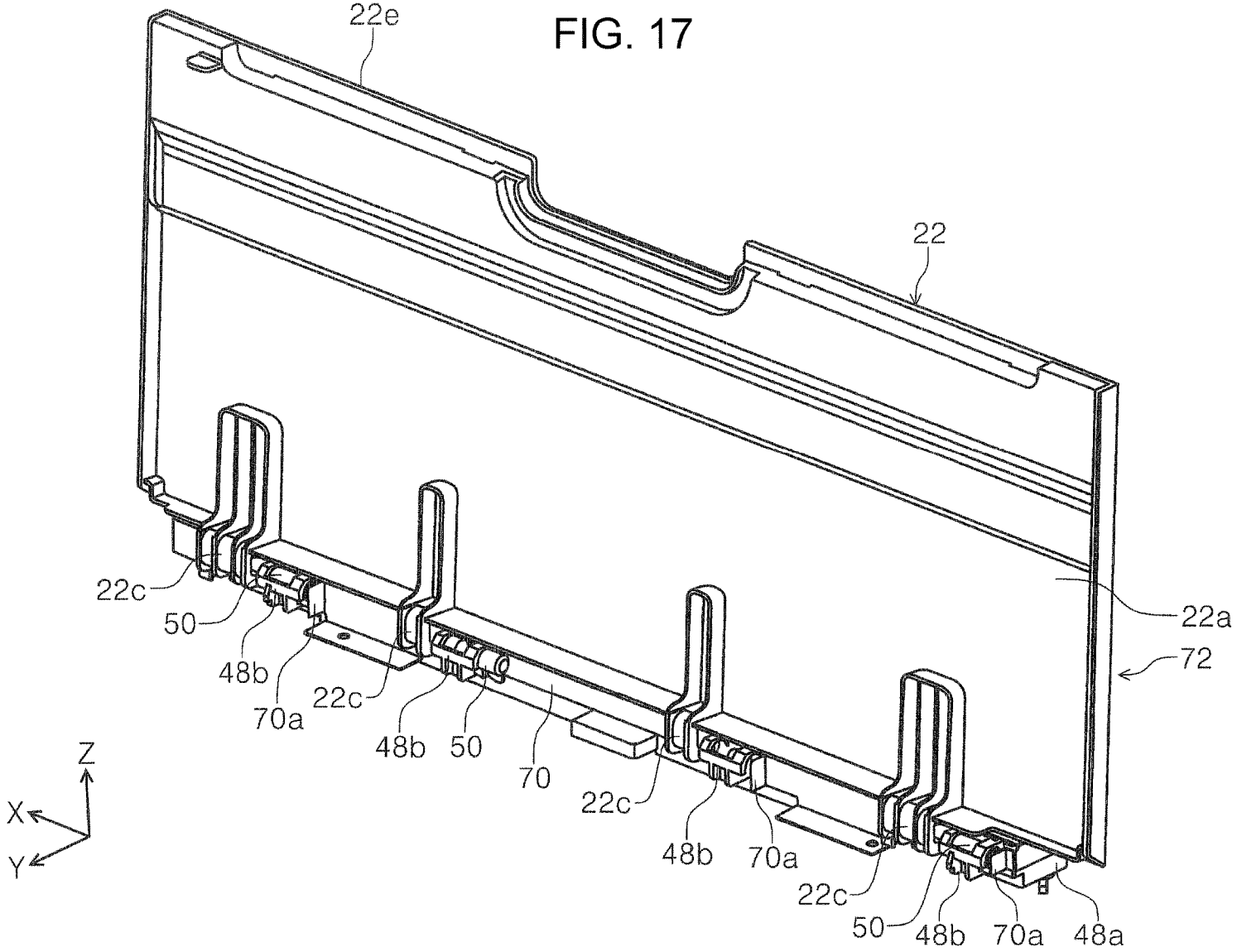
FIG. 17 is a perspective view of the cover assembly according to the second exemplary embodiment.
Figure 18:
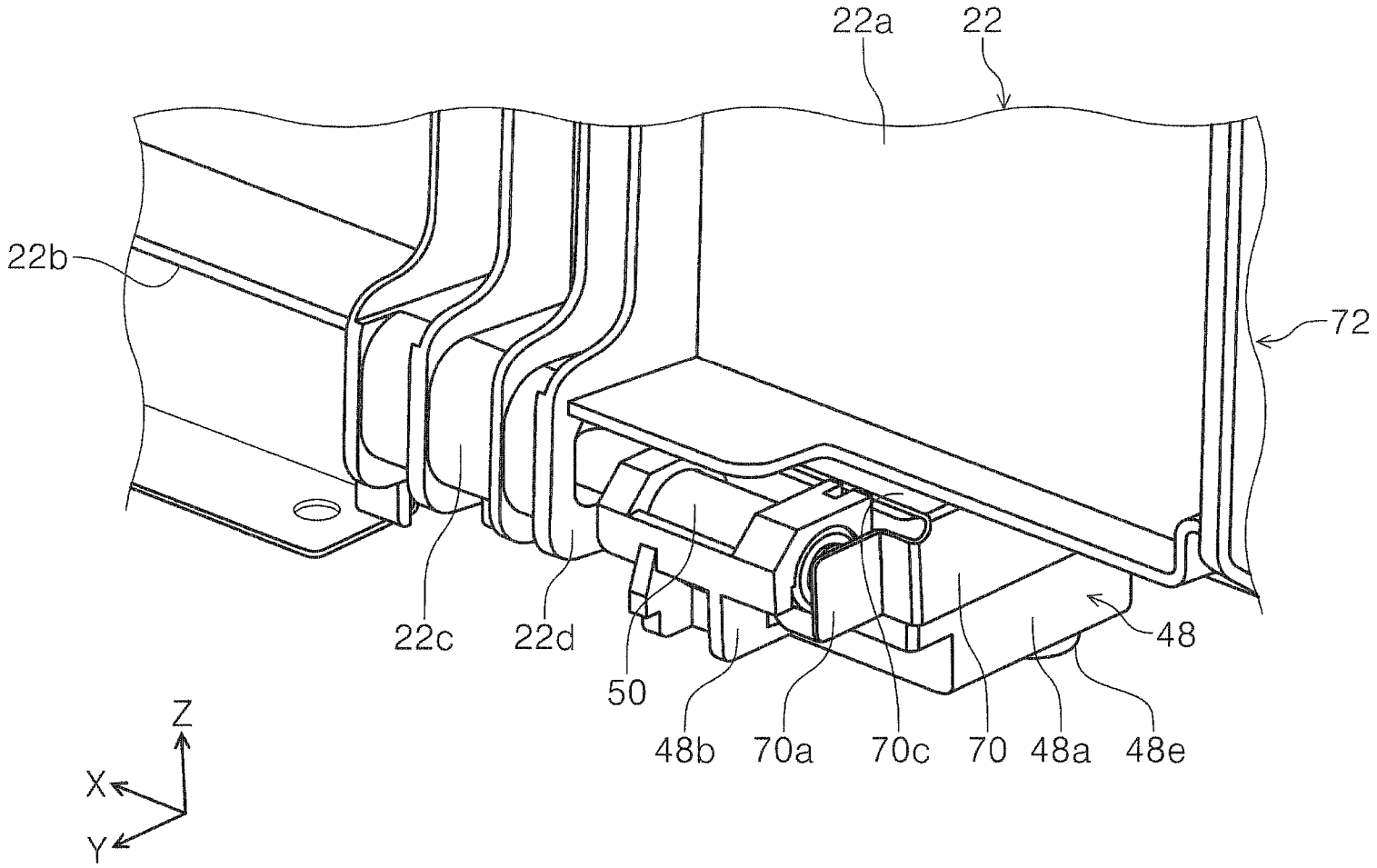
FIG. 18 is a perspective view illustrating a relationship between the damper and the holding member in the cover assembly according to the second exemplary embodiment.

FIG. 16 is a perspective view illustrating a state in which a cover assembly according to a second exemplary embodiment is attached to the apparatus main body, FIG. 17 is a perspective view of the cover assembly according to the second exemplary embodiment, and FIG. 18 is a perspective view illustrating a relationship between the damper and the holding member in the cover assembly according to the second exemplary embodiment.

Furthermore, in the X-Y-Z coordinate system illustrated in each of the drawings, the X direction indicates the width direction of the recording medium, in other words an apparatus width direction, the Y direction indicates a transport direction of a recording medium in the transport path inside the recording apparatus, in other words, an apparatus depth direction, and the Z direction indicates an apparatus height direction.

First Exemplary Embodiment

Outline of Printer

Referring to FIG. 1, an overall configuration of a printer 10 will be described. The printer 10 is configured as an ink jet printer serving as an example of the recording apparatus. The printer 10 includes a housing and an apparatus main body 11 that constitutes an inside of the housing. An operation unit 14 is provided on an apparatus front side of the apparatus main body 11. Operation members, such as the display panel and switches, are provided in the operation unit 14. A discharge tray 16 is provided in the −Z direction of the operation unit 14. The discharge tray 16 is switchable between a state (FIGS. 1 and 2) in which the discharge tray 16 is accommodated inside the apparatus main body 11 and a state (not shown) in which the discharge tray 16 is developed on the front side of the apparatus main body 11 so as to be projected on the apparatus front side.

In the apparatus main body 11, a medium accommodating cassette 18 that accommodates a medium therein is provided in the −Z direction of the discharge tray 16. In the present exemplary embodiment, the medium accommodating cassette 18 is detachable from the apparatus main body 11 through the front side of the apparatus main body 11.

A top surface member 20, a cover 22 serving as a "opening/closing body", and a rear feed port cover 24 are provided above the apparatus main body 11. The top surface member 20 is disposed above an edge portion of the apparatus main body 11 on the −Y direction side and forms a portion of an upper surface of the apparatus main body 11. The cover 22 is disposed above the apparatus main body 11 and on the +Y direction side with respect to the top surface member 20. The cover 22 is pivotable with respect to the apparatus main body 11 and is, with respect to the apparatus main body 11, switchable between an open position (FIGS. 2 and 3) and a closed position (FIG. 1).

The rear feed port cover 24 is pivotably disposed at an edge portion of the apparatus main body 11 on the −Y direction side, and is switchable between a closed position (FIG. 1) and an open position (not shown). A feed port 25 becomes exposed by opening the rear feed port cover 24 allowing a medium to be supplied to a feed roller 26 (described later) serving as a "feed member" from a rear side of the apparatus main body 11.

Outline of Medium Transport Path

Referring to FIG. 2, a medium transport path 28 will be described. The two-dot chain line to which a reference sign P-1 is attached in FIG. 2 depicts a route of the medium that is transported along the medium transport path 28 from the medium accommodating cassette 18 to the discharge tray 16. A pickup roller 30, an inverting roller 32, a transport roller pair 34, a recording head 36 serving as a "recording member", and a discharge roller pair 38 are disposed in the apparatus main body 11 in that order along the medium transport path 28.

The pickup roller 30 is provided on the +Z direction side of the medium accommodating cassette 18, and is pivotable about the pivot shaft 40 serving as a rotation fulcrum. The pickup roller 30 coming in contact with the medium accommodated in the medium accommodating cassette 18 transports the uppermost medium, among the mediums accommodated in the medium accommodating cassette 18, downstream in a transport direction along the medium transport path 28.

The medium sent out from the medium accommodating cassette 18 is warped and inverted by the inverting roller 32 and is sent to the transport roller pair 34 on the downstream side in the transport direction. The transport roller pair 34 sends the medium that has been sent from the inverting roller 32 to an area that opposes the recording head 36. The recording head 36 is provided under the carriage 42 and is capable of ejecting ink in the −Z direction. The carriage 42 is capable of reciprocating inside the apparatus main body 11 in the X-axis direction. The recording head 36 ejects ink onto the medium that has been sent thereto by the transport roller pair 34 and performs recording on a recording surface of the medium. The medium on which recording has been performed is nipped between the discharge roller pair 38 provided downstream of the recording head 36 in the transport direction, and is discharged towards the discharge tray 16 projecting towards the apparatus front side.

Referring to FIG. 2, the dot and dash line attached with the reference sign P-2 depicts a transport path of the medium transported from the feed port 25 towards the recording head 36. The feed port 25 is exposed by opening the rear feed port cover 24 with respect to the apparatus main body 11. The medium can be inserted into the apparatus main body 11 through the feed port 25. A medium supporting portion 27 is provided downstream of the feed port 25 in the medium transport direction. The medium supporting portion 27 supports the medium, which has been inserted through the feed port 25, with the medium in an inclined position. Note that the medium supporting portion 27 in the present exemplary embodiment is, as an example, configured as a hopper that is capable of swinging in directions in which the hopper comes in contact with and is separated from the feed roller 26 in a downstream area in the medium transport direction.

The feed roller 26 is provided downstream of the medium supporting portion 27 in the medium transport direction. A separating roller 44 is provided on the −Z axis direction side of the feed roller 26 and at a position opposing the feed roller 26.

The medium supported by the medium supporting portion 27 while in an inclined position is nipped between the feed roller 26 and the separating roller 44, and is sent to the transport roller pair 34. The transport roller pair 34 sends the medium that has been sent from the feed port 25 to the area that opposes the recording head 36.

Subsequently, recording is performed with the recording head 36 on the medium that has been sent to the above area, and the medium is discharged towards the discharge tray 16 with the discharge roller pair 38.

Cover Assembly

Referring to FIGS. 3 to 14, a configuration of the cover 22 will be described. Referring to FIG. 3, the cover 22 is disposed above the apparatus main body 11 and in front of the top surface member 20. An area where the carriage 42 moves in the X-axis direction is exposed when the cover 22 is opened with respect to the apparatus main body 11. Note that although illustration is omitted in FIG. 3, a plurality of ink cartridges are detachably mounted in the carriage 42. The ink cartridges are mounted in the carriage 42 in such a manner that each ink cartridge is positioned so that the longitudinal direction thereof extends in the X-axis direction. Moreover, the plurality of ink cartridges are mounted in the carriage 42 so that the ink cartridges are aligned in the Y-axis direction.

Referring to FIGS. 4 and 5, a cover assembly 46 is attached on the upper portion of the apparatus main body 11. The cover assembly 46 includes the cover 22, an attaching member 48, a plurality of dampers 50, and a pivot shaft 52.

Referring to FIG. 5, a main body portion 22*a* that is formed in a planer manner and that is capable of covering a portion above the apparatus main body 11, and a plurality of arm portions 22*c* that, in an edge portion 22*b* (the edge portion on the −Y-axis direction side in FIG. 4, and the edge portion on the −Z-axis direction side in FIG. 5) of the main body portion 22*a* on the attaching member 48 side, project from the main body portion 22*a* are formed in the cover 22. The plurality of arm portions 22*c* are appropriately disposed at intervals in the X-axis direction.

Referring to FIGS. 8 and 9, the arm portions 22*c* on the +Y direction side of the edge portion 22*b* of the main body portion 22*a* on the attaching member 48 side (the lower portion of the edge portion 22*b* when the cover 22 is in the closed position) each, while being projected, extend towards the attaching member 48 side (the −Z direction in FIGS. 8 and 9), and changing the extended direction, distal end portions 22*d* thereof each extends towards the −Y direction side. The pivot shaft 52 is inserted in the distal end portions 22*d*. Note that in FIGS. 8 and 9, the cover 22 is in the open position with respect to the attaching member 48.

Referring to FIG. 6, the attaching member 48 is provided so as to extend in the X-axis direction, and includes a base body portion 48*a* that is formed in a box shape that is open on the +Z direction side. A plurality of damper attaching portions 48*b* are provided at an edge portion of the base body portion 48*a* on the +Y-axis direction side at appropriate intervals in the X-axis direction. Moreover, bearings 48*c* are, at an edge portion of the base body portion 48*a* on the +Y-axis direction side, provided at both edge portions in the X-axis direction.

FIG. 7 illustrates the damper 50 according to the present exemplary embodiment. Each damper 50 according to the present exemplary embodiment includes, as an example, a damper main body 50*a*, a rib 50*b*, and a rotor 50*c*. The damper main body 50*a* is formed in a column shape, for example. The rib 50*b* projects from the damper main body 50*a* in a radial direction of the damper main body 50*a*. The rotor 50*c* is a rod-shaped member that extends in the X-axis direction, in which one end side is inserted in the damper main body 50*a* and the other end projects from the damper main body 50*a*.

In the present exemplary embodiment, each damper 50 is a known rotary damper, for example. A liquid, for example, is filled between the damper main body 50*a* and the rotor 50*c* so that, with the viscous resistance of the liquid (oil or the like), damping force (braking force) acts on the movement of the rotor 50*c* rotating relative to the damper main body 50*a*. Note that while, as an example, liquid is used in the damper 50, gas, or an urging member such as a spring may be used. Furthermore, not only a rotary damper, the damper 50 may be a vibration damper or the like that applies damping force (braking force) to the rotational movement.

Referring to FIGS. 8 and 9, an assembling process of the cover assembly 46 will be described. After positioning between the distal end portions 22*d* of the arm portions 22*c* of the cover 22 and the bearings 48*c* of the attaching member 48 is performed, the pivot shaft 52 is inserted through the distal end portions 22*d* and the bearings 48*c* to pivotably connect the cover 22 and the attaching member 48 to each other.

An attaching process of the dampers 50 will be described next. Referring to FIG. 8, a recess 48*d* is provided in the damper attaching portions 48*b*. The shape of the recess 48*d* corresponds to the shape of the rib 50*b* of the damper 50 (FIG. 14). For example, the damper 50 is slid from the −X direction side of the damper attaching portions 48*b* towards the damper attaching portions 48*b* side. In so doing, the damper 50 is inserted into the damper attaching portions 48*b* while positioning is performed so that the rib 50*b* fits into the recess 48*d*. Moreover, the rotor 50*c* of the damper 50 is press fitted into the distal end portion 22*d* of the arm portion 22*c*. With the above, the assembling of the cover assembly 46 is completed. Note that in the present exemplary embodiment, a plurality of dampers 50 are disposed between the cover 22 and the attaching member 48. As a result, damping force (braking force) of the plurality of dampers 50 acts between the cover 22 and the attaching member 48.

Attaching Cover Assembly to Apparatus Main Body

Referring to FIGS. 10 and 11, the apparatus main body 11 includes a center frame 54 (FIG. 11) and side frames 56A and 56B. As illustrated in FIG. 2, the center frame 54 is disposed between the feed roller 26 and the carriage 42 in the Y-axis direction. The center frame 54 is provided so as to extend in the X-axis direction that is the moving direction of the carriage 42. The side frames 56A and 56B are connected to the two sides of the center frame 54 in the X-axis direction. In the present exemplary embodiment, the cover assembly 46 is attached to the apparatus main body 11 and above the apparatus main body 11 with the side frames 56A and 56B interposed therebetween.

Specifically, referring to FIG. 11, attaching portions 48*e* are provided on both edge portions in the X-axis direction of the base body portion 48*a* of the attaching member 48 of the cover assembly 46. The attaching portions 48*e* are configured so that fastening members 58 (FIG. 10) can be inserted therein. As illustrated in FIGS. 10 and 11, the attaching member 48 is fixed to the side frames 56A and 56B with the fastening members 58 while the attaching portions 48*e* are abutted against the upper portions of the side frames 56A and 56B. As a result, the side frames 56A and 56B are not only fixed to the center frame 54 but are also fixed to the attaching member 48; accordingly, the rigidity of a frame body constituted by the center frame 54 and the side frames 56A and 56B can be increased. Note that while the fastening members 58 according to the present exemplary embodiment are, as an example, screws, the fastening members 58 may be bolts or the like.

Position of Attaching Member with Respect to Apparatus Main Body

Referring to FIGS. 2 and 14, a relationship between the cover 22 and the attaching member 48, and the apparatus main body 11 in a state in which the cover assembly 46 is attached to the apparatus main body 11 will be described. Referring to FIG. 14, a guide frame 60 is provided on the +Y-axis direction side of the center frame 54. The guide frame 60 is provided so as to extend in the X-axis direction and guides the motion of the carriage 42 in the X-axis direction. In the present exemplary embodiment, a height of an upper end portion 60*a* of the guide frame 60 in the Z-axis direction is set higher than a height of an upper end portion 54*a* of the center frame 54.

Referring to FIG. 2, the attaching member 48 of the cover assembly 46 is disposed in an area above (the +Z direction side) the feed roller 26 in the Y-axis direction. Furthermore, referring to FIG. 14, at least a portion of the attaching member 48, specifically, the damper attaching portions 48*b* and the bearings 48*c*, are positioned above (on the +Z direction side of) the center frame 54 in the Y-axis direction. Moreover, at least a portion of each damper 50, at least a portion of the pivot shaft 52 (the broken line portion in FIG. 14), and at least a portion of each arm portion 22*c* are positioned above (on the +Z direction side of) the center frame 54.

With the above, an occupying area of the center frame 54 and occupying areas of the attaching member 48, the dampers 50, the pivot shaft 52, and the arm portions 22*c* can be made to overlap each other in the Y-axis direction; accordingly, the size in the Y-axis direction can be suppressed.

Referring to FIG. 14, the two-dot chain line to which reference numeral 22-1 is attached illustrates a state in which the cover 22 is closed with respect to the apparatus main body 11. Reference numeral 22*b*-1 illustrates the edge portion 22*b* in a state in which the cover 22 is closed, and the reference numeral 22*c*-1 illustrates the arm portions 22*c* in a state in which the cover 22 is closed. In a state in which the cover 22 is closed with respect to the apparatus main body 11, at least a portion of each arm portion 22*c* (see the two-dot chain line to which the reference numeral 22*c*-1 is attached) is, in the Z-axis direction, positioned inside a step formed by the upper end portion 54*a* of the center frame 54 and the upper end portion 60*a* of the guide frame 60. As a result, a portion of each arm portion 22*c* can be disposed while using the step; accordingly, the space can be used efficiently and the size in the Z-axis direction can be suppressed.

Moreover, in a state in which the cover 22 is closed, the arm portions 22*c* are each formed so as to have a shape avoiding a front edge portion 20*a* of the top surface member 20. Specifically, each arm portion 22*c* extends in the −Y direction from below the edge portion 22*b* and changes the extending direction towards the +Z direction side so as to be attached to the pivot shaft 52. In as state in which the cover 22 is closed, each arm portions 22*c* avoids the front edge portion 20*a*, and is positioned on the −Z direction side of the front edge portion 20*a*. When the cover 22 is pivoted from a state in which the cover 22 is closed (the two-dot chain line portion to which the reference numeral 22-1 is attached) to a state in which the cover 22 is open (a solid line portion in FIG. 14), the arm portions 22*c* and the front edge portion 20*a* do not interfere with each other since the arm portions 22*c* are each formed in a shape that avoids the front edge portion 20*a* of the top surface member 20.

As a result, the main body portion 22*a* of the cover 22 can be configured closer to the front edge portion 20*a* of the top surface member 20, and a gap 62 (FIG. 14) between the main body portion 22*a* and the front edge portion 20*a* can be made smaller. With the above, entering of dust into the apparatus main body 11 through the gap 62 can be prevented or reduced. Furthermore, since the gap 62 can be made smaller, the top surface member 20 and the cover 22 that form the upper surface of the apparatus main body 11 can appear as if the top surface member 20 and the cover 22 are integrated; accordingly, the appearance of the apparatus can be improved.

As illustrated in FIGS. 2, 3, and 14, compared with a case in which the pivot shaft of the cover 22 is provided at an edge portion of the apparatus main body 11 on the −Y direction side, the pivot shaft 52 of the cover 22 is positioned closer to the front edge portion 20*a* of the top surface member 20 in the Y-axis direction. Accordingly, compared with the case in which the pivot shaft of the cover 22 is provided at an edge portion of the apparatus main body 11 on the −Y direction side, the length of the main body portion 22*a* of the cover 22 in the Y-axis direction can be decreased. Specifically, the length from a front edge portion (a free edge portion) 22*e* of the cover 22 to the pivot shaft 52 in the Y-axis direction becomes shorter. With the above, the height of the front edge portion 22*e* of the cover 22 in the Z-axis direction can be made shorter when the cover 22 is switched to an open state (FIG. 3) from a closed state (FIG. 1).

As a result, even in a case in which the printer 10 is installed in a low installing space, the cover 22 can be opened/closed without pulling out the printer 10 from the installing space. Alternatively, even if the cover 22 cannot be fully opened, since a sufficient opening amount of the cover 22 is obtained, the user can easily put a hand inside the moving area of the carriage 42 in the apparatus main body 11 and easily remove the medium jammed inside the moving area.

Referring to FIG. 15, a plurality of ribs 20*b* are provided in the top surface member 20. In a state in which the cover assembly 46 and the top surface member 20 are attached to the apparatus main body 11, the plurality of ribs 20*b* are each disposed at a position on the opposite side with respect to the side on which the rotor 50*c* of the corresponding damper 50 is provided. With the above, the ribs 20*b* prevent the dampers 50 from falling out from the damper attaching portions 48*b* and the distal end portions 22*d* of the arm portions 22*c*.

Cable Wiring Around Cover Assembly

Referring to FIGS. 12, 13, and 15, cable wiring around the cover assembly 46 of the apparatus main body 11 will be described. A sheet metal member 64 is provided so as to cover an underside of the base body portion 48*a* of the attaching member 48 and an edge portion of the base body portion 48*a* on the −Y direction side. The sheet metal member 64 is formed of a metal material.

Referring to FIG. 12, a control unit (not shown) is provided on the side frame 56B on the +X direction side. Cable 66 extending from the control unit is adhered on a rear surface (a surface on the −Y direction side) 64*a* of the sheet metal member 64 and extends in the −X-axis direction. After extending to a position corresponding to the feed roller 26 in the X-axis direction, the cable 66 is connected to a medium detection sensor (not shown) provided inside the apparatus main body 11.

Cable 68 is a length of distribution cable that extends inside the apparatus main body 11 from a waste liquid tank (not shown) disposed on the side frame 56A side to the control unit (not shown). The cable 68 passes a portion above the side frame 56A, extends in the +X-axis direction after passing between, as illustrated in FIG. 13, the base body portion 48*a* of the attaching member 48 and the sheet metal member 64 in the Y-axis direction, and is connected to the control unit (not shown). Note that in the present exemplary embodiment, as an example, the cables 66 and 68 are each a flexible flat cable (FFC) for signal transmission. In the exemplary embodiment, since the cables 66 and 68 are wired along the sheet metal member 64, noise created in the cables 66 and 68 can be reduced.

Second Exemplary Embodiment

Referring to FIGS. 16 to 18, a second exemplary embodiment will be described. The second exemplary embodiment is different from the first exemplary embodiment in that the second exemplary embodiment includes a holding member 70. Note that the configurations of the cover 22, the attaching member 48, and the dampers 50 are similar to those of the first exemplary embodiment; accordingly, description thereof is omitted.

Referring to FIG. 16, the holding member 70 covers a portion above the base body portion 48*a* of the attaching member 48. Moreover, as illustrated in FIGS. 17 and 18, a plurality of ribs 70*a* that extend towards the +Y direction side are provided in the holding member 70 at appropriate intervals in the X-axis direction. In a state in which the holding member 70 is attached to the attaching member 48, the ribs 70*a* are each provided at a position on the opposite side with respect to the side in which the rotor 50*c* of the corresponding damper 50 is provided. With the above, the ribs 70*a* prevent the dampers 50 from falling out from the damper attaching portions 48*b* and the distal end portions 22*d* of the arm portions 22*c*.

The cover 22, the attaching member 48, the dampers 50, and the holding member 70 can be configured as a cover assembly 72 by attaching the holding member 70 to the attaching member 48 after the dampers 50 are attached to the attaching member 48. When the cover assembly 72 is mounted on the apparatus main body 11, the holding member 70 prevents the dampers 50 from falling out; accordingly, work of mounting the cover assembly 72 on the apparatus main body 11 is facilitated.

In the present exemplary embodiment as well, the cable 66 is a signal cable that connects the control unit (not shown) and the medium detection sensor (not shown) to each other. In the exemplary embodiment, the cable 66 extended out from the control unit is adhered to a rear edge portion 70*b* of the holding member 70 that covers the upper portion of the base body portion 48*a* of the attaching member 48, is extended in the −X-axis direction, and is connected to the medium detection sensor (not shown).

Meanwhile, similar to the first exemplary embodiment, the cable 68 extends from the waste liquid tank (not shown) disposed on the side frame 56A side to the control unit (not shown). In the present exemplary embodiment, the cable 68 passes a portion above the side frame 56A, extends in the +X-axis direction at an upper surface 70*c* of the holding member 70, and is connected to the control unit (not shown). Note that in the present exemplary embodiment as well, the holding member 70 is formed of a metal material. Accordingly, since the cables 66 and 68 are wired along the holding member 70, noise created in the cables 66 and 68 can be reduced.

Modifications of First Exemplary Embodiment and Second Exemplary Embodiment (1) Each exemplary embodiment is configured so that the attaching member 48 is connected to the side frames 56A and 56B. However, instead of the above configuration, the attaching member 48 may be attached to the center frame 54.

(2) In each exemplary embodiment, the cables 66 and 68 are wired along the sheet metal member 64 or the holding member 70. However, instead of the above configuration, a cut-out portion may be provided in the base body portion 48*a* of the attaching member 48 so that communication is established in the X-axis direction in FIG. 13, and the cables 66 and 68 may be wired so as to extend in the X-axis direction through the cut-out portion. The above configuration allows the space inside the base body portion 48*a* to be used effectively, and a space for laying the cables 66 and 68 to be provided separately; accordingly, the space of the apparatus can be saved.

The above description will be Summarized. The printer 10 includes the recording head 36 that performs recording on a medium, the feed roller 26 that feeds the medium, which is set in an inclined position, towards the recording head 36, the cover 22 that opens/closes the portion above the area in which the recording head 36 is disposed, and the dampers 50 that apply damping force to the cover 22 when the cover 22 is closed. The cover 22 and the dampers 50 are attached through the attaching member 48 disposed in an area above the feed roller 26.

There is a lot of space area above the feed roller 26 that feeds the medium, which is set in an inclined position, towards the recording head 36. Accordingly, in each exemplary embodiment, the cover 22 and the dampers 50 are attached through the attaching member 48 that is disposed in the area above the feed roller 26. Accordingly, an increase in the size of the printer 10 can be suppressed with the above.

Furthermore, since the attaching member 48 is positioned above the feed roller 26 that feeds the medium, which is set in an inclined position, towards the recording head 36, assuming that the direction extending along the feeding direction of the medium sent out from the feed roller 26 is an apparatus depth direction (the Y-axis direction), in the apparatus depth direction (the Y-axis direction), the attaching member 48 is positioned not at the edge portion of an apparatus rear side (the −Y-axis direction side) but at a position that is on an apparatus front side (+Y-axis direction side, or the recording head 36 side) with respect to the edge portion.

Furthermore, since the cover 22 is attached in an openable/closable manner through the attaching member 48 in between, the pivot shaft 52 that is a rotational center of the cover 22 is also positioned at where the attaching member 48 is positioned. In other words, the pivot shaft 52 that is the rotational center of the cover 22 is also positioned not at the edge portion of the apparatus rear side (the −Y-axis direction side) but at a position that is on an apparatus front side (+Y-axis direction side) with respect to the edge portion.

With the above, since the distance between the pivot shaft 52 that is the rotational center of the cover 22 and the front edge portion 22*e* that is a rotation free edge of the cover 22 decreases, the length from the pivot shaft 52 of the cover 22 to the front edge portion 22*e* becomes shorter, and the height of the front edge portion 22*e* of the cover 22 when the cover 22 is open can be reduced. Accordingly, even when the printer 10 is installed in an installation space that is low in height, the cover 22 can be opened without pulling out the apparatus from the installed space, or even when the cover 22 cannot be opened completely, a sufficient opening amount can be obtained, and user-friendliness can be improved.

The printer 10 includes a carriage 42 that includes the recording head 36 constituting the recording member and that reciprocates in the apparatus width direction (X-axis direction), the center frame 54 that is positioned between the moving area of the carriage 42 and the area in which the feed roller 26 is disposed and that is provided so as to extend in the moving direction of the carriage 42, and the two side frames 56A and 56B that are provided at the two sides of the center frame 54. The attaching member 48 is fixed to the two side frames 56A and 56B. With such a configuration, the rigidity of the frame body constituted by the center frame 54 and the two side frames 56A and 56B can be increased.

The printer 10 includes a carriage 42 that includes the recording head 36 constituting the recording member and that reciprocates in the apparatus width direction (X-axis direction), and the center frame 54 that is positioned between the moving area of the carriage 42 and the area in which the feed roller 26 is disposed and that is provided so as to extend in the moving direction of the carriage 42. At least a portion of the pivot shaft 52 of the cover 22 and at least a portion of each damper 50 are positioned above the center frame 54. With such a configuration, the occupying area of the center frame 54 and the occupying areas of the pivot shaft 52 and the dampers 50 are not completely superimposed on each other in the apparatus depth direction (Y-axis direction), and the size in the apparatus depth direction (Y-axis direction) can be suppressed.

The printer 10 includes a carriage 42 that includes the recording head 36 constituting the recording member and that reciprocates in the apparatus width direction (X-axis direction), and the center frame 54 that is positioned between the moving area of the carriage 42 and the area in which the feed roller 26 is disposed and that is provided so as to extend in the moving direction of the carriage 42. At least a portion of the attaching member 48 is positioned above the center frame 54. With such a configuration, the occupying area of the center frame 54 and the occupying area of the attaching member 48 are not completely superimposed on each other in the apparatus depth direction (Y-axis direction), and the size in the apparatus depth direction (Y-axis direction) can be suppressed.

The attaching member 48 is fixed to the center frame 54.

The cover 22 includes the arm portions 22*c* that connect the main body portion 22*a*, and the pivot shaft 52 that is the rotational center of the main body portion 22*a* and the cover 22 to each other. The top surface member 20 constituting the apparatus upper surface together with the cover 22 is provided above the attaching member 48. The arm portions 22*c* each have a shape that avoids the front edge portion 20*a* of the top surface member 20 when the cover 22 is opened/closed.

With such a configuration, the main body portion 22*a* and the front edge portion 20*a* of the top surface member 20 can be configured closer to each other. As a result, in a state in which the cover 22 is closed, the gap 62 between the main body portion 22*a* and the front edge portion 20*a* of the top surface member 20 can be made smaller, the entering of dust and the like into the apparatus main body 11 through the gap 62 can be suppressed, and the appearance of the printer 10 can be improved.

The printer 10 includes a carriage 42 that includes the recording head 36 constituting the recording member and that reciprocates in the apparatus width direction (X-axis direction), and the center frame 54 that is positioned between the moving area of the carriage 42 and the area in which the feed roller 26 is disposed and that is provided so as to extend in the moving direction of the carriage 42. At least a portion of each arm portion 22*c* is positioned above the center frame 54. With such a configuration, the occupying area of the center frame 54 and the occupying area of the arm portions 22*c* are not completely superimposed on each other in the apparatus depth direction (Y-axis direction), and the size in the apparatus depth direction can be suppressed.

The printer 10 includes the guide frame 60 on the recording head 36 side with respect to the center frame 54 in the apparatus depth direction (Y-axis direction). The guide frame 60 guides the carriage 42 in the moving direction (X-axis direction). The upper end portion 60*a* of the guide frame 60 is positioned at a position higher than the position of the upper end portion 54*a* of the center frame 54, and at least a portion of each arm portion 22*c* is, in the height direction (Z-axis direction), positioned inside a step formed by the upper end portion 60*a* of the guide frame 60 and the upper end portion 54*a* of the center frame 54. With such a configuration, an increase in the size of the apparatus can be suppressed through effective use of the space.

The feed member includes the feed roller 26 that feeds the medium, and at least a portion of the attaching member 48 is positioned above the feed roller 26.

The printer 10 includes the holding member 70 that is attached to the attaching member 48. In a state in which the holding member 70 is attached to the attaching member 48, the holding member 70 holds the dampers 50. With such a configuration, the dampers 50 can be prevented from falling off when the cover assembly 72 formed by attaching the dampers 50 to the attaching member 48 is mounted on the apparatus main body 11; accordingly, the efficiency of the assembly work is improved.

Furthermore, in the exemplary embodiments, the cover 22, the attaching member 48, and the dampers 50 according to the invention are applied to an ink jet printer that is an example of the recording apparatus; however, the cover 22, the attaching member 48, and the dampers 50 can be applied to any other general liquid ejection apparatus.

Herein, the liquid ejection apparatus is not limited to a recording apparatus such as a printer, a copying machine, or a facsimile machine that performs recording on a recording medium by using an ink jet recording head to eject ink from the recording head, but also includes an apparatus that ejects liquid, which meets the purpose of the apparatus and is provided in place of the ink, onto a medium to be ejected, which corresponds to the recording medium, from a liquid ejection head, which corresponds to the ink jet recording head, to deposit the liquid onto the medium to be ejected.

Other than the recording head described above, the liquid ejection head may include, for example, a color material ejection head that is used to manufacture color filters for liquid crystal displays and the like, an electrode material (conductive paste) ejection head that is used to form electrodes for organic EL displays, surface emitting displays (FED), and the like, a bio organic matter ejecting head used to manufacture biochips, and a sample ejection head serving as a precision pipette.

Note that the invention is not limited to the exemplary embodiments described above and may be modified in various ways that is within the scope of the claims. It goes without saying that the modifications are also included in the scope of the invention.

The entire invention of Japanese Patent Application No. 2017-073800, filed Apr. 3, 2017, is expressly incorporated by reference herein.

What is claimed is:

1. A recording apparatus comprising:

a housing;

an apparatus main body that constitutes an inside of the housing;

the apparatus main body including:

a recording member that performs recording on a medium, a feed roller that feeds the medium, the medium being set at an inclined position, towards the recording member, an opening/closing body that opens/closes a portion above an area in which the recording member is disposed, and a damper that applies damping force to the opening/closing body when the opening/closing body is closed, wherein the opening/closing body and the damper are attached to the apparatus main body through an attaching member disposed at an area above the feed roller, wherein the attaching member includes a box like shape with a damper attaching portion for attaching the damper.

2. The recording apparatus according to claim 1, further comprising:

a carriage that includes the recording head constituting the recording member, the carriage reciprocating in an apparatus width direction;

a center frame positioned between a moving area of the carriage and an area in which the feed roller is disposed, the carriage being provided so as to extend in a moving direction of the carriage; and two side frames provided at two sides of the center frame, wherein the attaching member is fixed to the two side frames.

3. The recording apparatus according to claim 1, further comprising:

a carriage that includes the recording head constituting the recording member, the carriage reciprocating in an apparatus width direction; and a center frame positioned between a moving area of the carriage and an area in which the feed roller is disposed, the carriage being provided so as to extend in a moving direction of the carriage, wherein a portion of a pivot shaft of the opening/closing body and a portion of the damper are positioned above the center frame.

4. The recording apparatus according to claim 1, further comprising:

a carriage that includes the recording head constituting the recording member, the carriage reciprocating in an apparatus width direction; and a center frame positioned between a moving area of the carriage and an area in which the feed roller is disposed, the carriage being provided so as to extend in a moving direction of the carriage, and wherein at least a portion of the attaching member is positioned above the center frame.

5. The recording apparatus according to claim 4, wherein the attaching member is fixed to the center frame.

6. The recording apparatus according to claim 1, wherein the opening/closing body includes a main body portion and an arm portion that connects the main body portion and a rotational center of the main body portion and the opening/closing body, wherein a top surface member constituting an apparatus upper surface together with the opening/closing body is provided above the attaching member, and wherein the arm portion has a shape that avoids an edge portion of the top surface member when the opening/closing body is opened/closed.

7. The recording apparatus according to claim 6, further comprising:

a carriage that includes the recording head constituting the recording member, the carriage reciprocating in an apparatus width direction; and a center frame positioned between a moving area of the carriage and an area in which the feed roller is disposed, the carriage being provided so as to extend in a moving direction of the carriage, wherein at least a portion of the arm portion is positioned above the center frame.

8. The recording apparatus according to claim 7, further comprising:

a guide frame on a recording member side with respect to the center frame, the guide frame guiding the carriage in the moving direction, wherein an upper end portion of the guide frame is at a position that is higher than an upper end portion of the center frame, and wherein at least a portion of the arm portion is, in a height direction, positioned inside a step formed between the upper end portion of the guide frame and the upper end portion of the center frame.

9. The recording medium according to claim 1, wherein at least a portion of the attaching member is positioned above the feed roller.

10. The recording medium according to claim 1, further comprising:

a holding member attached to the attaching member, wherein in a state in which the holding member is attached to the attaching member, the holding member holds the damper.

* * * * *